US008978174B2

(12) United States Patent
Drury et al.

(10) Patent No.: US 8,978,174 B2
(45) Date of Patent: Mar. 17, 2015

(54) WATER JET HOUSING WITH INTERNAL SLEEVE FOR LIMITING WATER AND/OR AIR FLOW

(75) Inventors: William J. Drury, Peachtree City, GA (US); H. Charles Li, Peachtree City, GA (US)

(73) Assignee: Custom Molded Products, Inc., Newnan, GA (US)

( * ) Notice: Subject to any disclaimer, the term of this patent is extended or adjusted under 35 U.S.C. 154(b) by 689 days.

(21) Appl. No.: 13/220,325

(22) Filed: Aug. 29, 2011

(65) Prior Publication Data

US 2013/0048756 A1 Feb. 28, 2013

(51) Int. Cl.

| | |
|---|---|
| ***A61H 33/04*** | (2006.01) |
| ***B05B 7/04*** | (2006.01) |
| ***A61H 33/00*** | (2006.01) |
| ***A61H 33/02*** | (2006.01) |

(52) U.S. Cl.

CPC ..... *B05B 7/0425* (2013.01); *A61H 33/6052* (2013.01); *A61H 33/027* (2013.01); *A61H 2033/021* (2013.01); *A61H 2033/022* (2013.01); *A61H 2201/1253* (2013.01)

USPC ..... 4/541.6

(58) Field of Classification Search

CPC ..... A61H 2033/021; A61H 33/026; A61H 33/027; A61H 33/6052

USPC ..... 4/541.6; 239/428.5, 407

See application file for complete search history.

(56) References Cited

U.S. PATENT DOCUMENTS

| | | | | |
|---|---|---|---|---|
| 6,691,336 | B2 * | 2/2004 | Buck | 4/541.6 |
| 2005/0039251 | A1 * | 2/2005 | Colin | 4/541.6 |

* cited by examiner

*Primary Examiner* — Janie Christiansen

(74) *Attorney, Agent, or Firm* — Laurence P. Colton; Smith Risley Tempel Santos

(57) ABSTRACT

A water jet having a housing with a first attachment means having a first side, a second side opposite the first side, an inner side, and an outer side; an entrance slot accessible from the inner side and extending along the inner side a distance between the first side and the second side; a retaining path extending along at least one-quarter of the circumference of the first attachment means from the entrance slot, the retaining path for retaining a second attachment means; and a retainer located at a juncture between the entrance slot and the retaining path for removably retaining the second attachment means within the retaining path, wherein the retainer is movable from a locked or retaining position to an unlocked or releasing position and back; and a sleeve rotatably mounted within the housing, the sleeve having the second attachment means, the second attachment means being a protrusion extending radially outwardly from an outer surface of the sleeve, wherein when the retainer is in the locked or retaining position, with the second attachment means within the retaining path, the retainer prevents the second attachment means from exiting the retaining path without the retainer being moved into the unlocked or releasing position.

21 Claims, 22 Drawing Sheets

WATER JET HOUSING WITH INTERNAL SLEEVE FOR LIMITING WATER AND/OR AIR FLOW

BACKGROUND OF THE INVENTION

1. Technical Field

The present invention is directed generally to water jet components for use in spa and hydrotherapy equipment. The present invention is directed more specifically to water jet having an internal structural element that allows the water flow and/or air flow to be limited or turned on and off by twisting or rotating the internal structural element.

2. Related Art

Artificial water structures, such as conventional spas, hot tubs, whirlpool baths, swimming pools and the like, hereinafter referred to and defined as hydrotherapy equipment or tubs, comprise various components and features, such as jet. Jets inject water together with air, if desired, using venturi nozzles or jets, against the bodies of occupants usually partially immersed therein. Such jets allow the occupant to control the water or aerated water input to the hydrotherapy equipment or tub.

By way of example, typical hydrotherapy equipment with jets mounted thereon or therethrough are constructed as a molded shell to form a water containment or fluid enclosure having a footwell or floor and an upstanding sidewall. Molded within the enclosure are a plurality of therapy stations which may include seats or platforms for reclining. The shell typically is constructed of fiberglass, plastic or a similar material, or a composite of such materials, forming a tub. One or more pumps usually are placed under the shell (the dry-side) to draw water from the enclosure tub and discharge it, usually with air, into the enclosure tub (the wet-side) through a plurality of jets of various types, including venturi-type jets such as water jet aerators. The jets usually are mounted through the shell in either or both of the floor and sidewall. Typically, jets mounted through the sidewall are located below the water line of the hydrotherapy equipment.

Water jet aerators can be used in these artificial water structures to provide jets of aerated water to provide a massaging and therapeutic action. The massaging and therapeutic action usually is provided by water jet aerators that are recessed into the walls of the artificial water structures. Several water jet aerators are usually spaced about the perimeter of an artificial water structure. In some water jet aerators, the nozzles may be rotated to achieve a desired flow. The nozzle is often a swivel type nozzle, which allows the direction of the flow to be adjusted by the user of the artificial water structure for maximum massaging or therapeutic action.

As already mentioned, one type of water jet aerator that is in common use in artificial water structures uses the venturi process. The venturi process involves mixing a stream of pressurized water with ambient air. This venturi type action occurs in an aeration chamber, with the air being drawn into a low pressure chamber from a passageway that is connected to the ambient atmosphere. The low pressure is created by the flow of water through the low-pressure chamber. The mixture of pressurized water and air thereby provides an aerated jet of water, which then is discharged through a nozzle into the water contained in the artificial water structure.

These venturi-type water jet aerators often are adjustable and may include a flow control system for manually adjusting the flow of air or water, or a combination of the air and water. For example, a first type of control system for a water jet aerator operates by manipulating the water flow and maintaining a steady, constant air flow through the aerator. A second type of control system adjusts both the air flow and the water flow simultaneously and proportionally. A third type of flow control system allows for independent adjustment of both the airflow and the water flow.

For the most part, water jet aerators are manufactured with a sealed single part body into which different nozzles can be inserted. The single part body is mounted on the spa in an orientation selected by the installer, or at random if the installer has no desired or instructed orientation. The flow of water or air through the nozzle often can be adjusted by some means on the nozzle. For example, the nozzle may include some type of valve or shut-off that, when actuated, decreases or stops the flow of water and/or air through the nozzle. However, there are many different and popular types of nozzles that do not have such an adjustment means and therefore the flow of water and/or air through the nozzle cannot be adjusted or stopped. Also, many of the current water jet aerator housings do not allow for adjustment of the water and/or air flow into the housing component, or at a minimum do not allow for simple adjustment of the water and/or air flow into the housing component.

Accordingly, there is always a need for an improved water jet aerator system. For example, there is always a need for a water jet aerator that can accept nozzles and that can be adjusted simply and easily. Additionally, there is always a need for a water jet aerator that allows for simple adjustment of the water and/or air flow into the housing component. It is to these needs, among others, that the present invention is directed.

BRIEF SUMMARY OF THE INVENTION

Briefly, this invention is an improved water jet having a housing for mounting on the tub shell and a sleeve rotatably mounted within the housing that allows for adjusting the water and/or air flow into the housing. A removable nozzle can be inserted into the sleeve for directing the water flow, air flow, or aerated water flow into the tub. The sleeve preferably is attached to a face cover such that rotating the face cover causes the sleeve to rotate from a full on position to a full off position and back. Preferably, the invention allows a user to turn the water flow through the nozzle on and off by rotating the face cover approximately 90°.

The water jet of the present invention, like many water jets, comprises a nozzle, a face cover, a housing, an air conduit, and a water conduit. However, the present invention further comprises a rotatable sleeve that is inserted into and fits within the housing and into which the nozzle is inserted and fits. Also, the face cover, rather than being a separate piece that attaches to the housing as in conventional water jet aerator configurations, is a part of the sleeve such that the sleeve and the face cover are a unified structure. Further, an aeration chamber is located within the sleeve such that water and air entering the housing is directed into the sleeve, and more specifically is directed into the aeration chamber.

This invention is an improved water jet utilizing a two-part body design, in conjunction with a removable nozzle, that allows a user to control the air and/or water flow into the housing, and therefore into the sleeve and the nozzle. The housing preferably is a generally hollow structure having various sized cylindrical sections forming a generally continuous housing outer wall having an inner surface and an outer surface, a generally continuous interior, an open end for accepting the sleeve and the nozzle, and a closed end typically opposite the open end. Generally proximal to the closed end, the housing has a water inlet port and an air inlet port allowing for water and air to be introduced to the interior of the housing. The housing also preferably has a flange and a threaded portion proximal to the open end for attaching the housing to a tub wall. The housing further preferably has a housing attachment means for rotatably attaching the sleeve within the housing, the housing attachment means preferably being located within the interior of the housing and attached to the inner surface of the housing outer wall.

The sleeve also preferably is a generally hollow structure having various sized cylindrical sections forming a generally continuous sleeve outer wall having an inner surface and an outer surface, a generally continuous interior, a first open end for accepting the nozzle, and a second open end typically opposite the first open end and/or a water port for accepting a water flow from the water inlet port of the housing, specifically to the aeration chamber. Generally proximal to the second open end, the sleeve has at least one air port allowing for air to be introduced to the interior of the sleeve, specifically also to the aeration chamber. The sleeve also preferably has a face cover proximal to or at the first open end for gripping by the user so as to rotate the sleeve and for providing an aesthetically pleasing cover for the flange. The sleeve further preferably has a sleeve attachment means for cooperating with the housing attachment means, for rotatably attaching the sleeve within the housing, the sleeve attachment means preferably being located on the exterior of the sleeve and attached to the outer surface of the sleeve outer wall. The sleeve also has clips for holding the nozzle within the sleeve interior.

The housing is mounted through the tub shell in a more or less conventional manner. For example, the housing is placed through a hole in the tub shell such that the flange contacts the inner (wet side) surface of the tub shell. A threaded nut is placed over the housing from the outer side (dry side) and threaded onto the threaded portion of the housing. The nut is rotated about the threaded portion until it contacts the outer (dry side) surface of the tub shell, sandwiching the tub shell between the flange and the nut, thus securing the housing onto the tub shell.

The water flow to the aeration chamber preferably may be shut off by rotating the face cover, which thereby rotates the sleeve such that the water port rotates away from and therefore closes the water inlet port. The flow volume of water preferably also can be proportionally reduced by only partially rotating the face cover to a position where only a portion of the water inlet port is open, thus reducing the cross-section of the open area of the water inlet port cooperating with the water port. Similarly, the air flow to the aeration chamber preferably may be shut off by rotating the face cover, which thereby rotates the sleeve such that the air port rotates away from and therefore closes the air inlet port. The flow volume of air preferably also can be proportionally reduced by only partially rotating the face cover to a position where only a portion of the air inlet port is open, thus reducing the cross-section of the open area of the air inlet port cooperating with the air port.

As in conventional water jets, the aeration chamber creates an aerated water stream by the mixing of air and water, which have been introduced into the aeration chamber via the air inlet port and the water inlet port in the housing and the air port and the water port in the sleeve, and aligned with the aeration chamber. The aerated water stream then flows through the sleeve and then through the nozzle into the artificial water structure (for ease of this disclosure, all artificial water structures such as but not limited to spas, hot tubs, JACUZZI®, pools, fountains, ponds, and whirlpools will be referred to herein as a "spa" or "spas"). Preferably, the nozzle does not extend into the spa beyond the face cover and is accessible from the spa, namely from the front side of the aerator, if the user desires to change the nozzle. The nozzle has a fluid passage, which is in fluid communication with both the aeration chamber and the spa, to introduce aerated water into the spa.

These features, and other features and advantages of the present invention will become more apparent to those of ordinary skill in the relevant art when the following detailed description of the preferred embodiments is read in conjunction with the appended drawings in which like reference numerals represent like components throughout the several views. The figures and the detailed description which follow more particularly exemplify these and other embodiments of the invention.

BRIEF DESCRIPTION OF THE DRAWINGS

The invention may be more completely understood in consideration of the following detailed description of various embodiments of the invention in connection with the accompanying drawings, which are as follows.

DETAILED DESCRIPTION OF PREFERRED EMBODIMENTS

Figure 1:
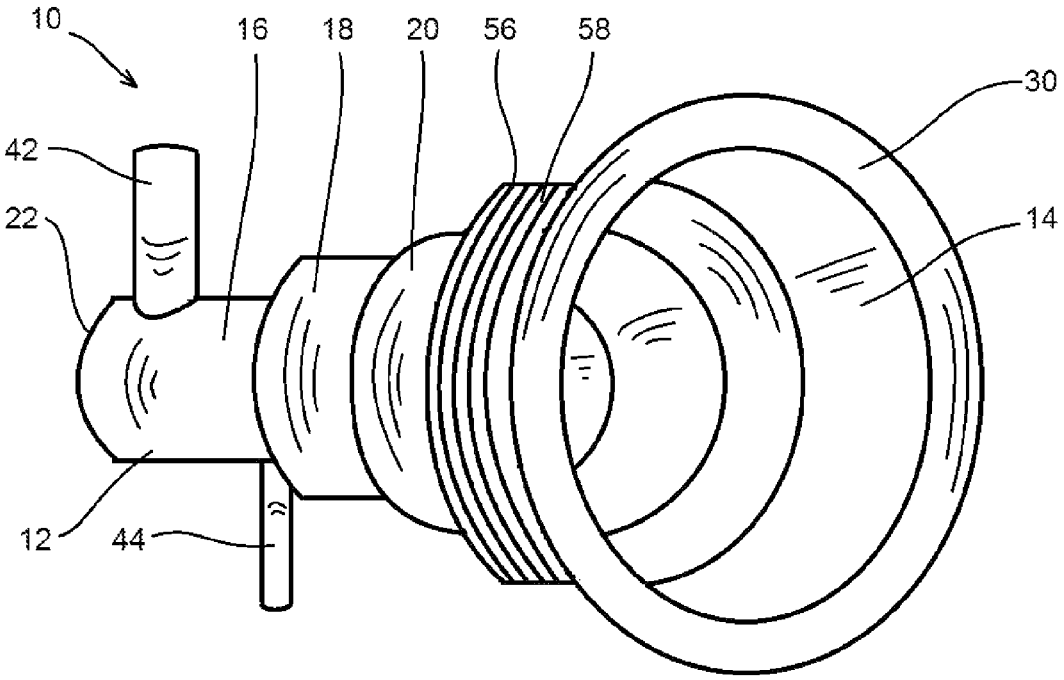
FIG. 1 is a perspective view of an embodiment of the invention.

FIG. 1 is a perspective view of an embodiment of the invention 10 showing sleeve 14 within housing 12, but not showing a nozzle mounted within sleeve 14. While the invention is amenable to various modifications and alternative forms, specifics thereof are shown by way of example in the drawings and described in detail herein. It should be understood, however, that the intention is not to limit the invention to the particular embodiments described. On the contrary, the intention is to cover all modifications, equivalents, and alternatives falling within the spirit and scope of the invention. It also will be understood that the hydrotherapy equipment described and illustrated herein is exemplary and, as defined herein, comprise spas, tubs, pools, showers, baths, ponds, Jacuzzis, and the like, each of which is within the scope of the present invention, and all of which are referred to as spas or tubs throughout the specification for simplicity.

Figure 2:
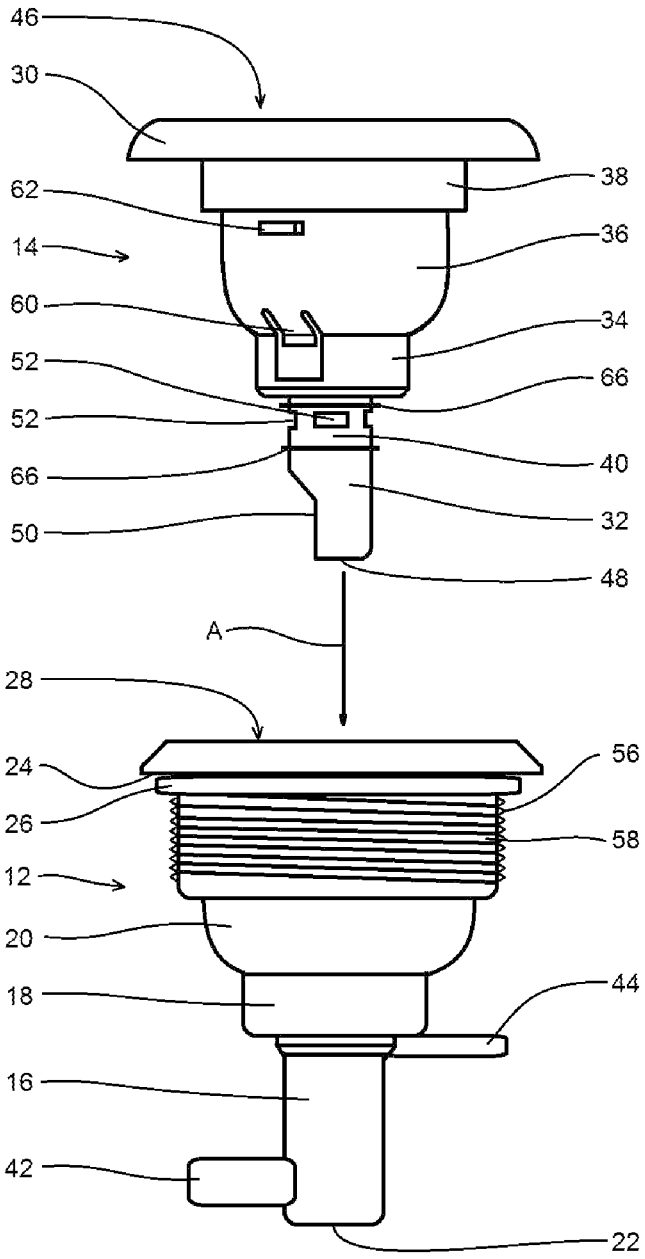
FIG. 2 is a side exploded view of the embodiment of the invention shown in FIG. 1.
Figure 3:
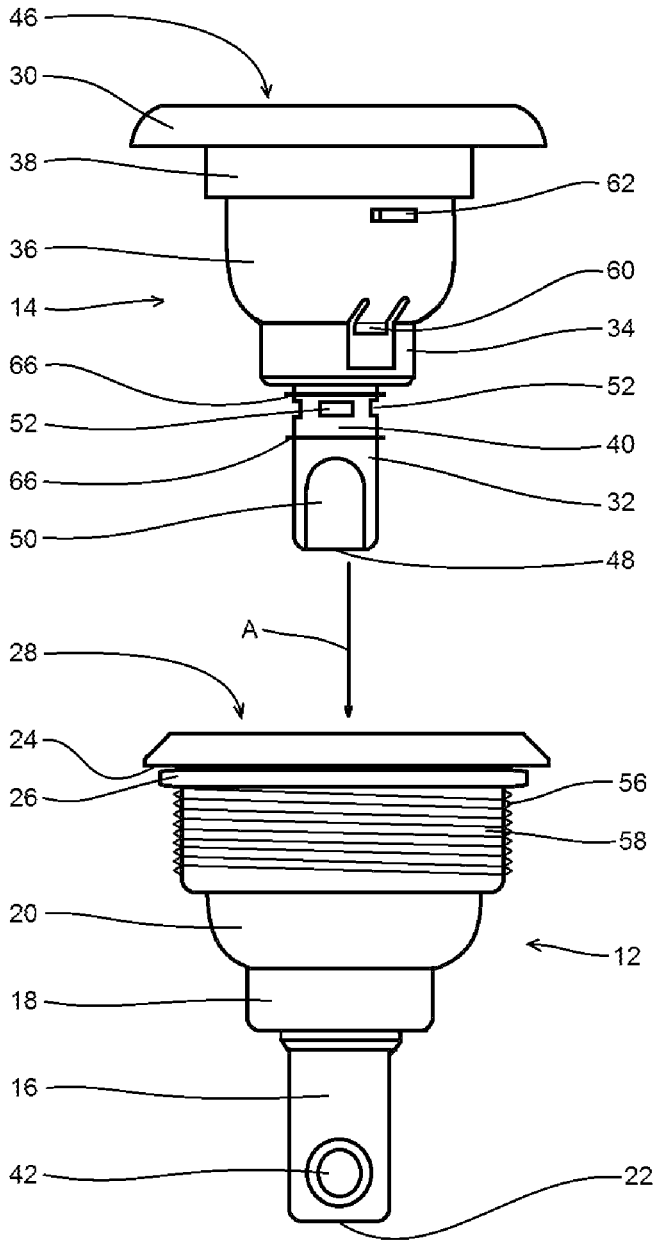
FIG. 3 is a side exploded view of the embodiment of the invention shown in FIG. 1 rotated axially 90° relative to FIG. 2.
Figure 4:
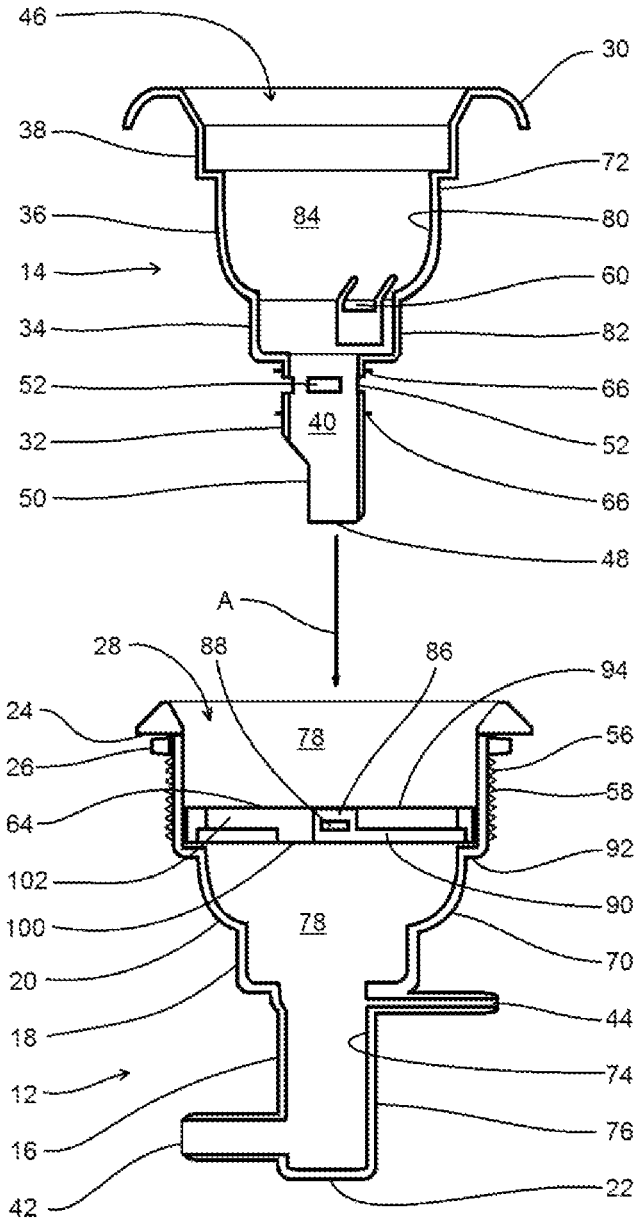
FIG. 4 is a side exploded sectional view of the embodiment of the invention shown in FIG. 1.
Figure 5:
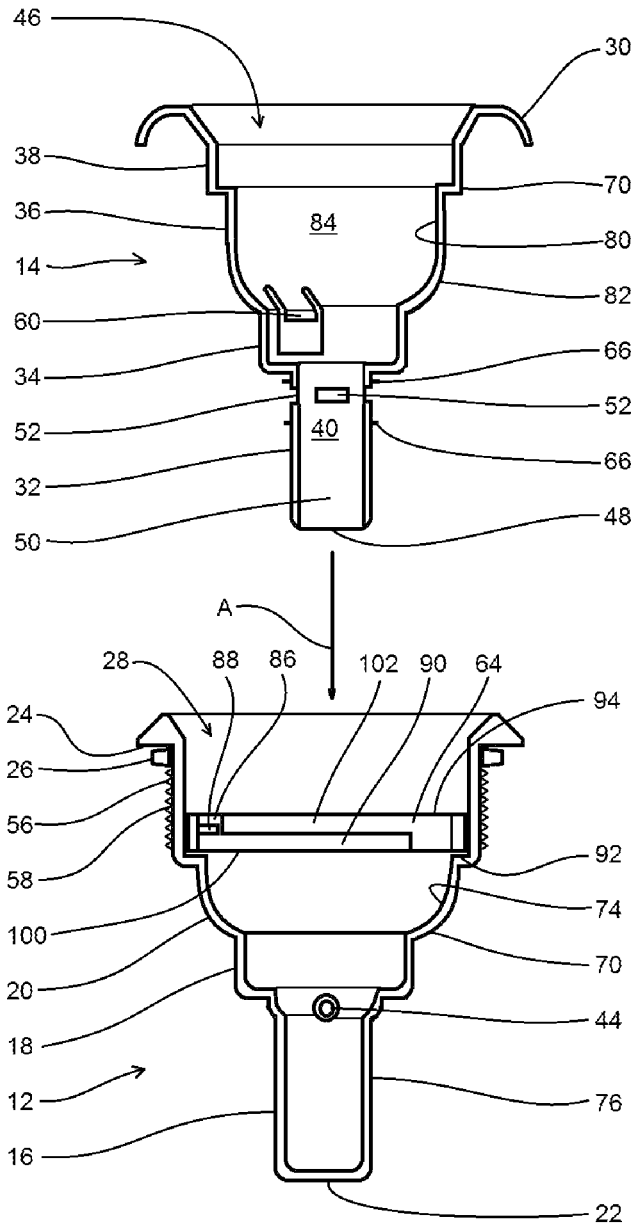
FIG. 5 is a side exploded sectional view of the embodiment of the invention shown in FIG. 1 rotated axially 90° relative to FIG. 4.

FIG. 2 is a side exploded view of the embodiment of the invention 10 shown in FIG. 1 showing sleeve 14 outside of housing 12. Arrow A represents both the manner in which sleeve 14 is inserted into housing 12 and the axis of both housing 12 and sleeve 14. FIG. 3 is a side exploded view of the embodiment of the invention 10 shown in FIG. 1 rotated axially 90° relative to FIG. 2. FIG. 4 is a side exploded sectional view of the embodiment of the invention 10 shown in FIG. 1. FIG. 5 is a side exploded sectional view of the embodiment of the invention 10 shown in FIG. 1 rotated axially 90° relative to FIG. 4. Each of FIGS. 2-5 show sleeve 14 in a position relative to, and to be inserted into, housing in the full on position, namely allowing water and air to flow into housing 12, and then into sleeve 14. Further, the configurations of the air ports on sleeve 14 in FIGS. 2-5 allow air to flow through sleeve 14 when sleeve 14 is both in the full on and the full off position with respect to the water flow through sleeve 14.

Figure 6:
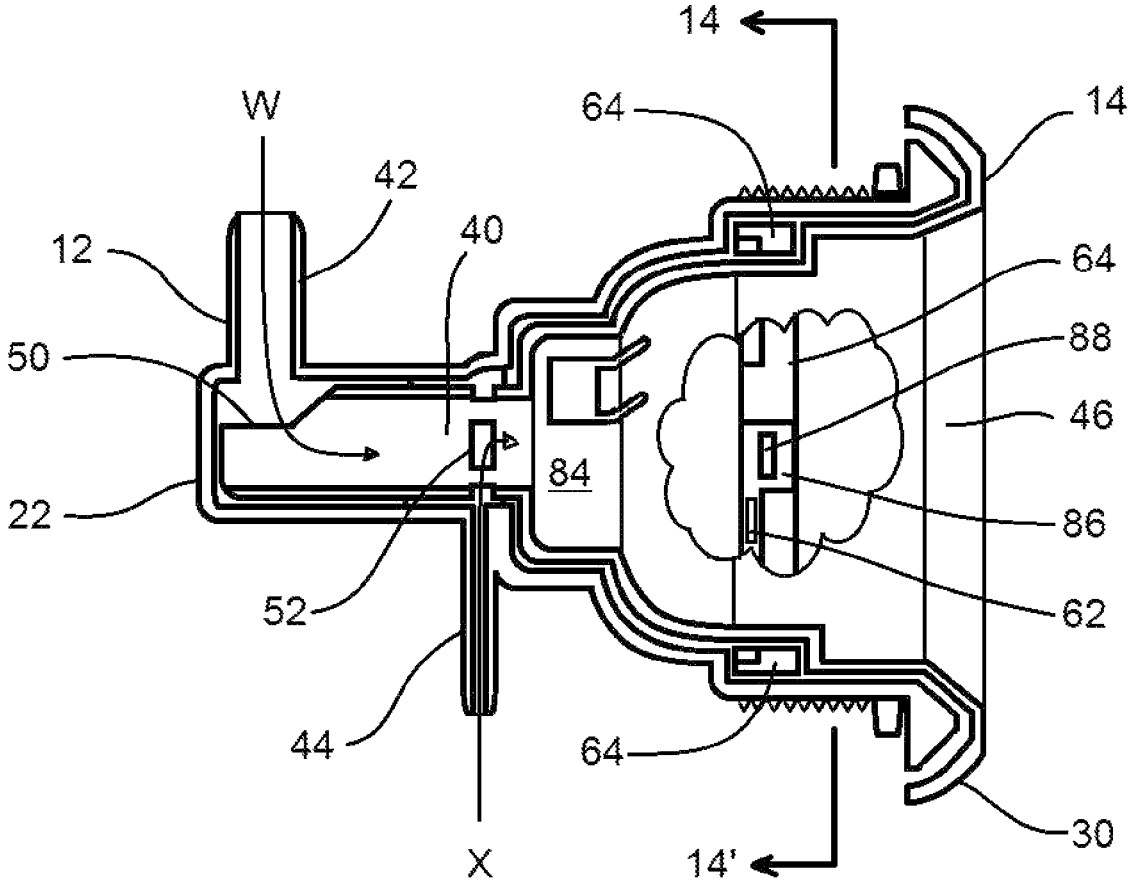
FIG. 6 is a side sectional view of the embodiment of the invention shown in FIG. 1 in a setting allowing water to flow through the invention.
Figure 7:
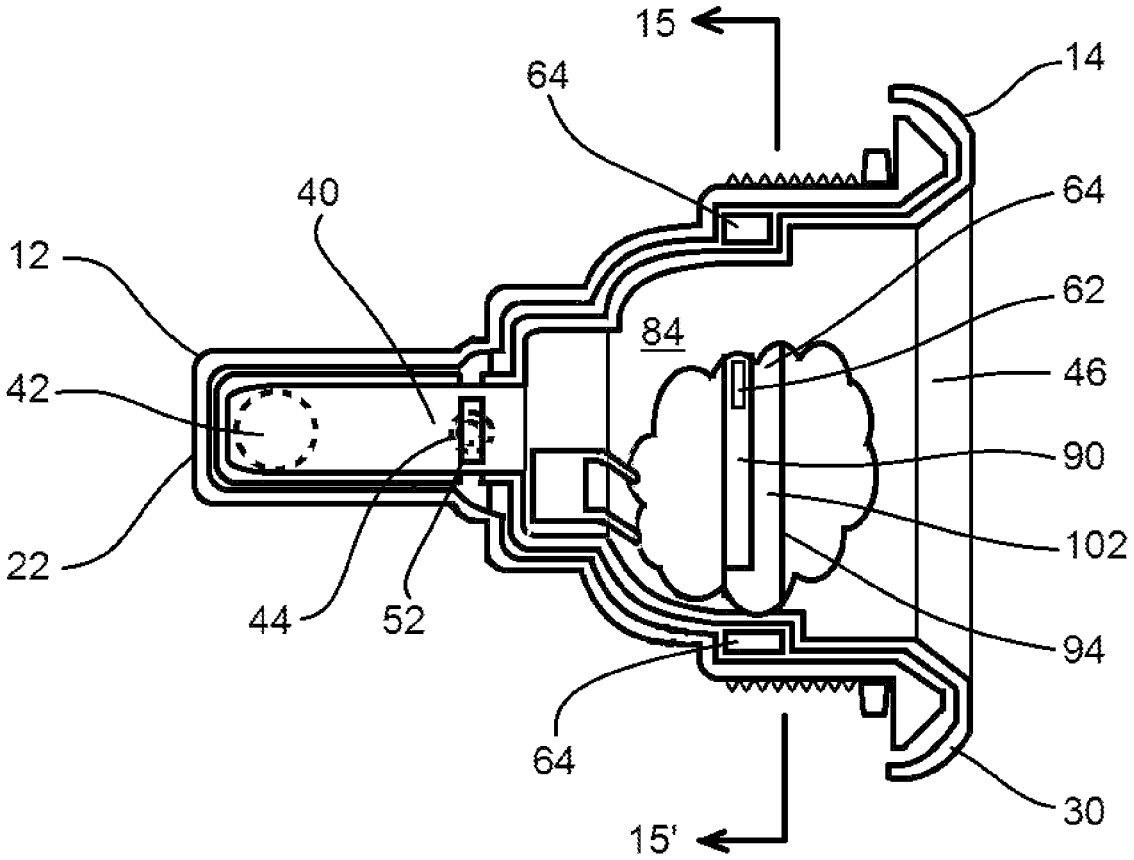
FIG. 7 is a side sectional view of the embodiment of the invention shown in FIG. 1 rotated axially 90° relative to FIG. 6 in a setting allowing water to flow through the invention.

FIG. 6 is a side sectional view of the embodiment of the invention 10 shown in FIG. 1 in a setting allowing water to flow through the invention 10. FIG. 7 is a side sectional view of the embodiment of the invention 10 shown in FIG. 1 rotated axially 90° relative to FIG. 6 in a setting allowing water to flow through the invention 10. FIGS. 6 and 7 illustrate sleeve 14 mounted within housing 12 in the full on position, namely allowing water and air to flow into housing 12, and then into sleeve 14. FIGS. 6 and 7 also show an additional section through the wall of sleeve 14 to illustrate the connection means.

Figure 8:
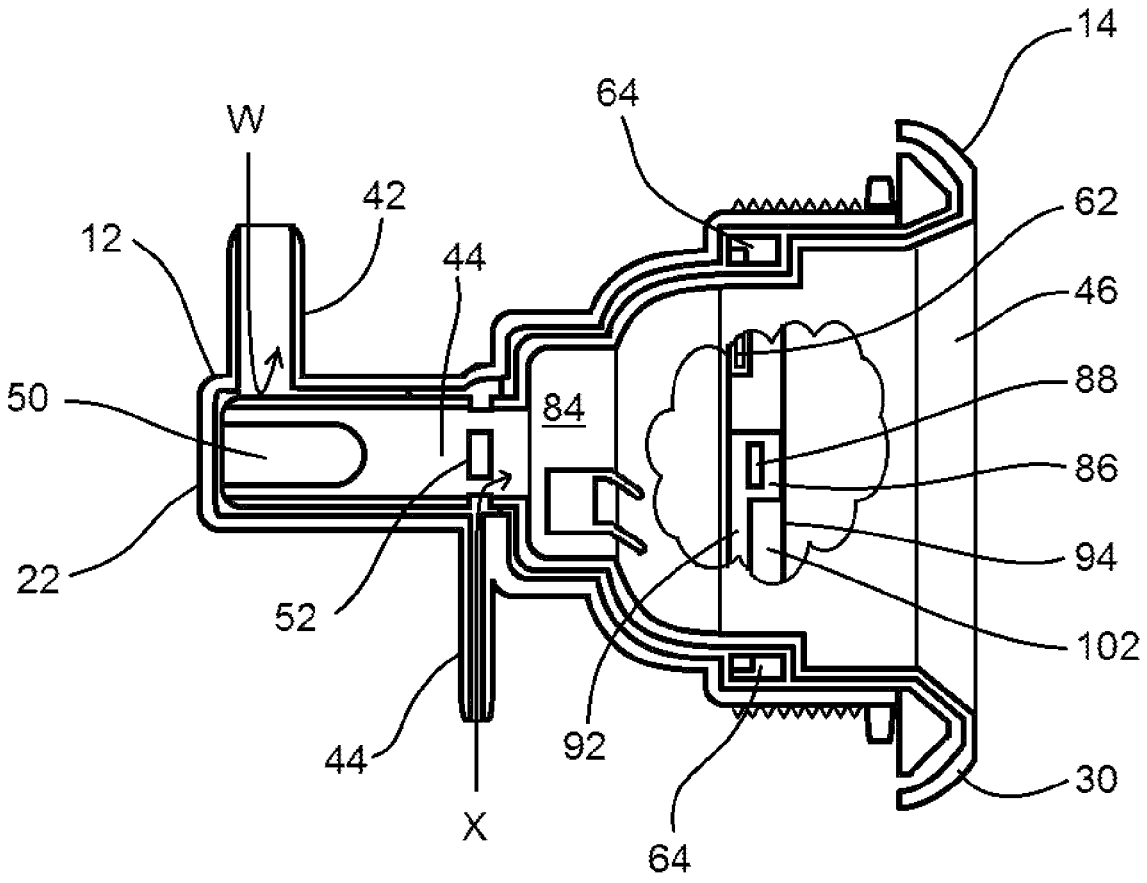
FIG. 8 is a side sectional view of the embodiment of the invention shown in FIG. 1 in a setting preventing water from flowing through the invention.
Figure 9:
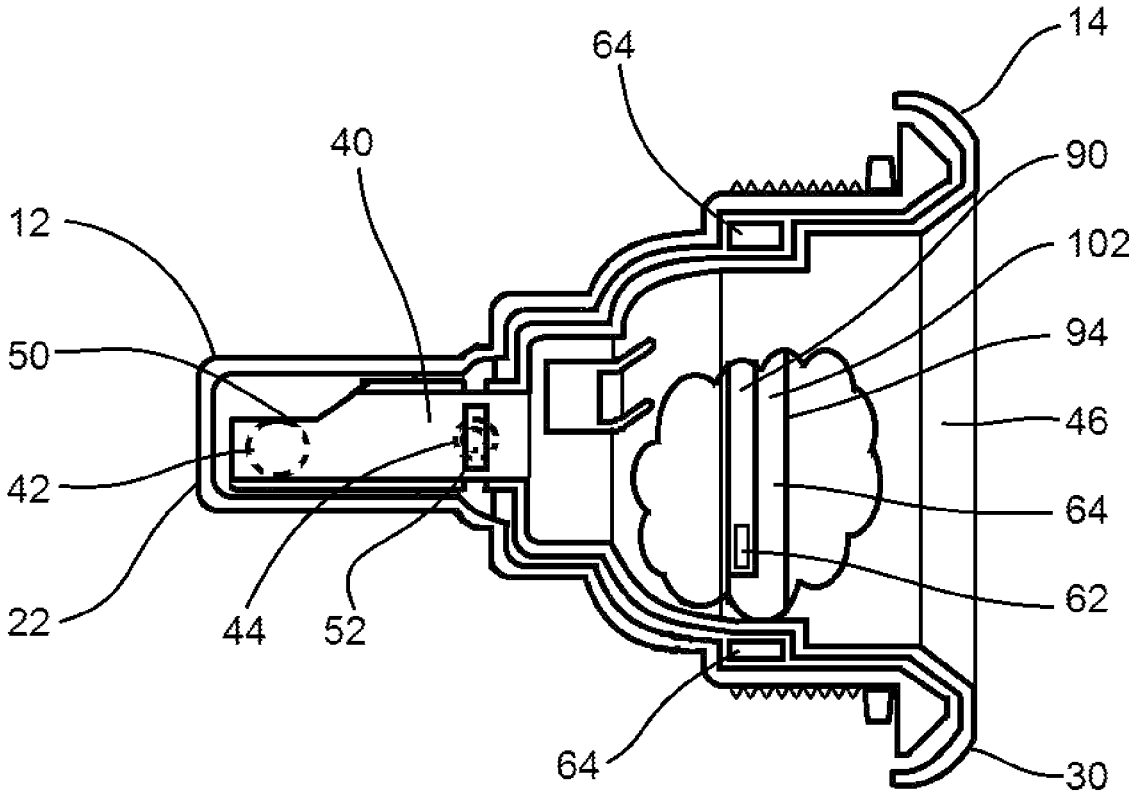
FIG. 9 is a side sectional view of the embodiment of the invention shown in FIG. 1 rotated axially 90° relative to FIG. 8 in a setting preventing water from flowing through the invention.

FIG. 8 is a side sectional view of the embodiment of the invention 10 shown in FIG. 1 in a setting preventing water from flowing through the invention 10. FIG. 9 is a side sectional view of the embodiment of the invention 10 shown in FIG. 1 rotated axially 90° relative to FIG. 8 in a setting preventing water from flowing through the invention 10. FIGS. 8 and 9 illustrate sleeve 14 mounted within housing 12 in the off position, namely preventing water from flowing into housing 12. FIGS. 8 and 9 also show an additional section through the wall of sleeve 14 to illustrate the connection means.

Figure 10:
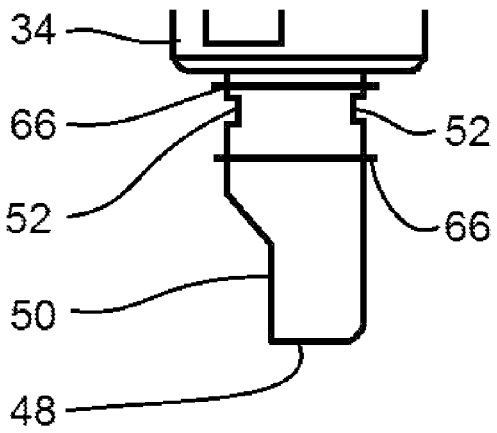
FIG. 10 is a side view of an alternative structure of the invention that allows air to flow through the invention when water is allowed to flow through the invention and prevents air from flowing through the invention when water is prevented from flowing through the invention.
Figure 12:
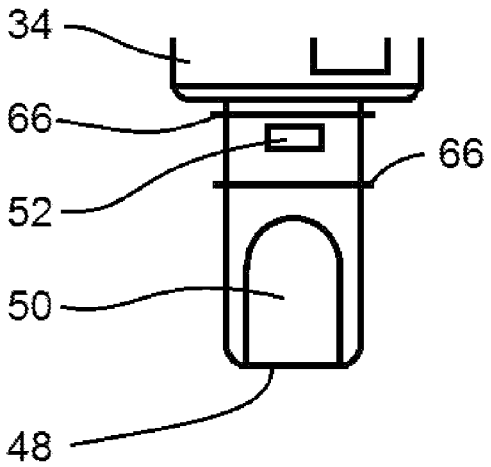
FIG. 12 is a side view of the alternate embodiment of the invention shown in FIG. 10 rotated axially 90° relative to FIG. 10.

FIG. 10 is a side view of an alternative structure of the invention that allows air to flow through the invention when water is allowed to flow through the invention and prevents air from flowing through the invention when water is prevented from flowing through the invention. More specifically, when sleeve 14 is in the full on position relative to water flow through sleeve 14, air also can flow through sleeve, and when sleeve 14 is in the full off position relative to water flow through sleeve 14, air cannot flow through sleeve 14. FIG. 12 is a side view of the alternate embodiment of the invention shown in FIG. 10 rotated axially 90° relative to FIG. 10.

Figure 11:
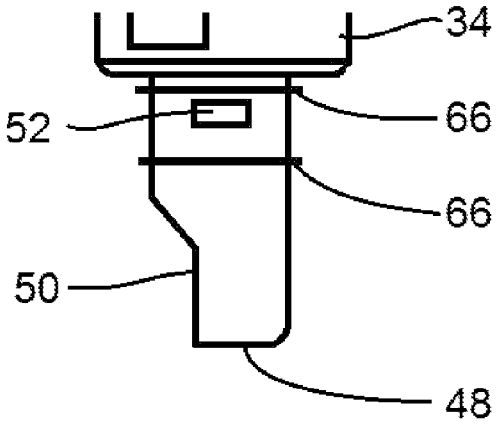
FIG. 11 is a side view of an alternate structure of the invention that prevents air from flowing through the invention when water is allowed to flow through the invention and allows air to flow through the invention when water is prevented from flowing through the invention.
Figure 13:
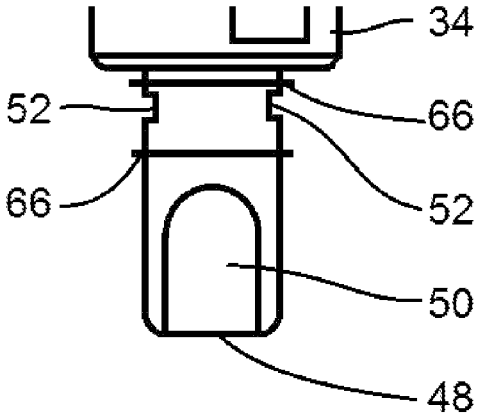
FIG. 13 is a side view of the alternate embodiment of the invention shown in FIG. 11 rotated axially 90° relative to FIG. 11.

FIG. 11 is a side view of an alternate structure of the invention that prevents air from flowing through the invention when water is allowed to flow through the invention and allows air to flow through the invention when water is prevented from flowing through the invention. More specifically, when sleeve 14 is in the full on position relative to water flow through sleeve 14, air cannot flow through sleeve, and when sleeve 14 is in the full off position relative to water flow through sleeve 14, air can flow through sleeve 14. FIG. 13 is a side view of the alternate embodiment of the invention shown in FIG. 11 rotated axially 90° relative to FIG. 11.

Figure 14:
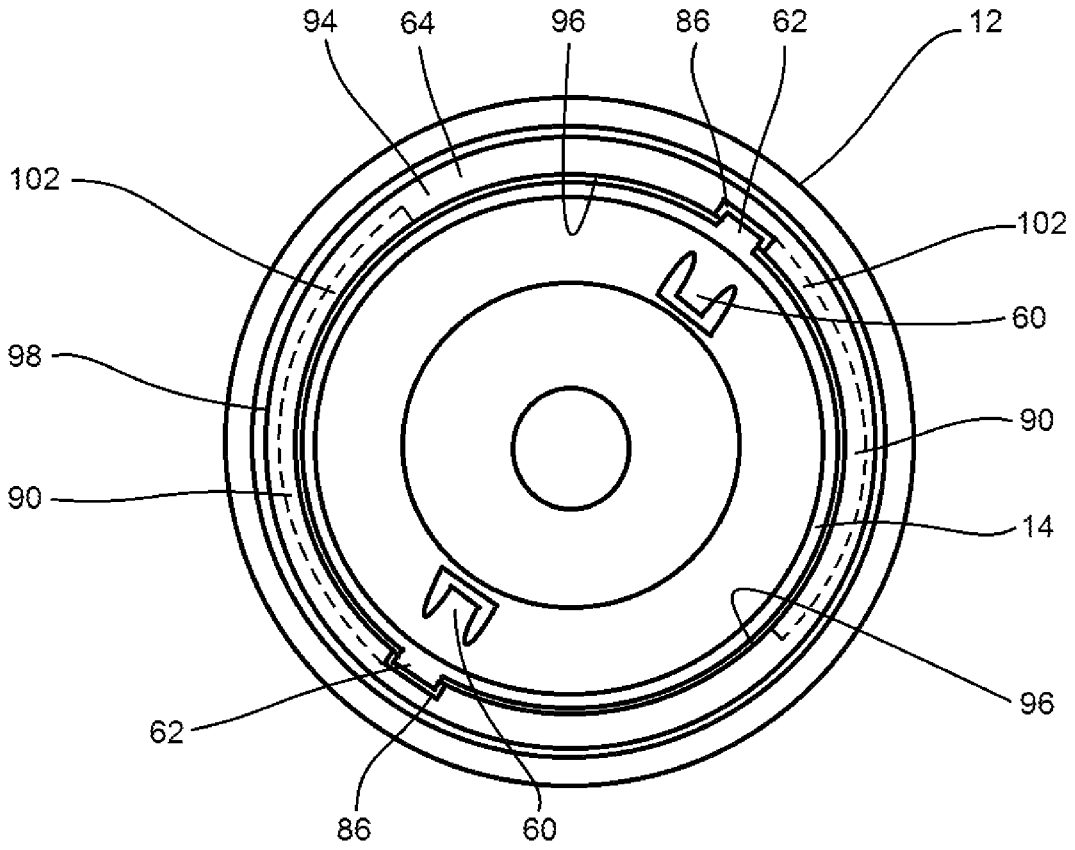
FIG. 14 is an end view, partly in section, along line 14-14' of FIG. 6.
Figure 15:
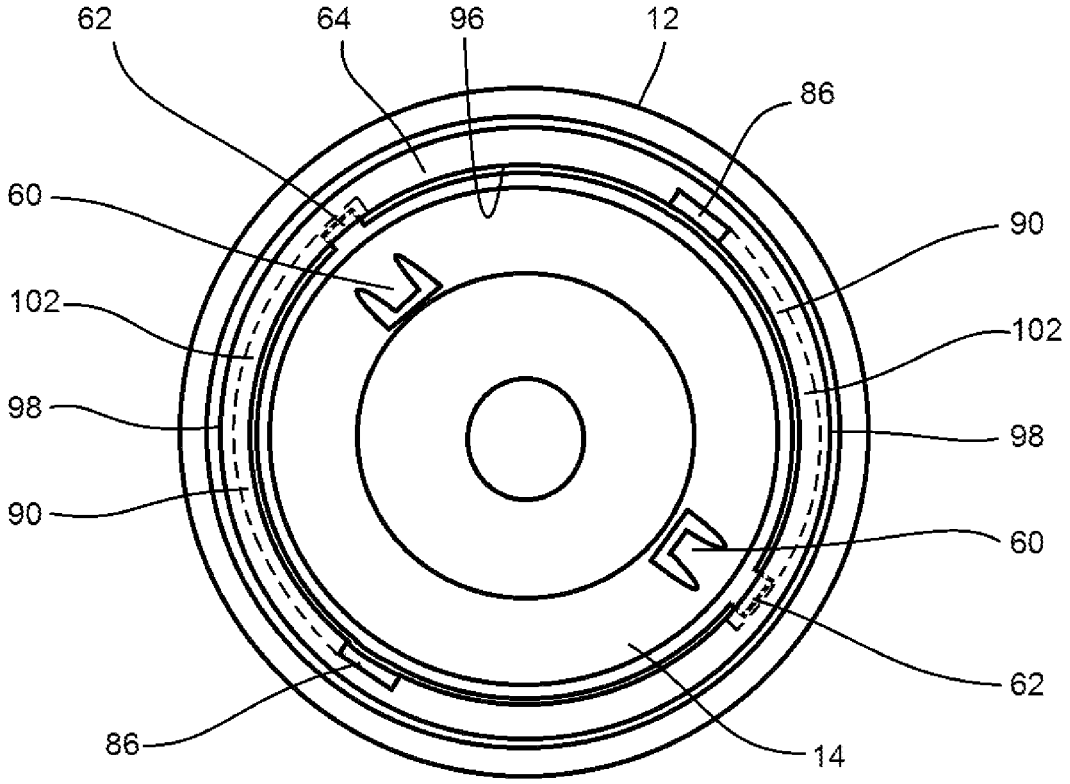
FIG. 15 is an end view, partly in section, along line 15-15' of FIG. 7.

FIGS. 14 and 15 are end views, partly in section, along line 14-14' of FIG. 6 and along line 15-15' of FIG. 7, respectively, for better illustrating the means for attaching the sleeve to the housing.

Figure 16:
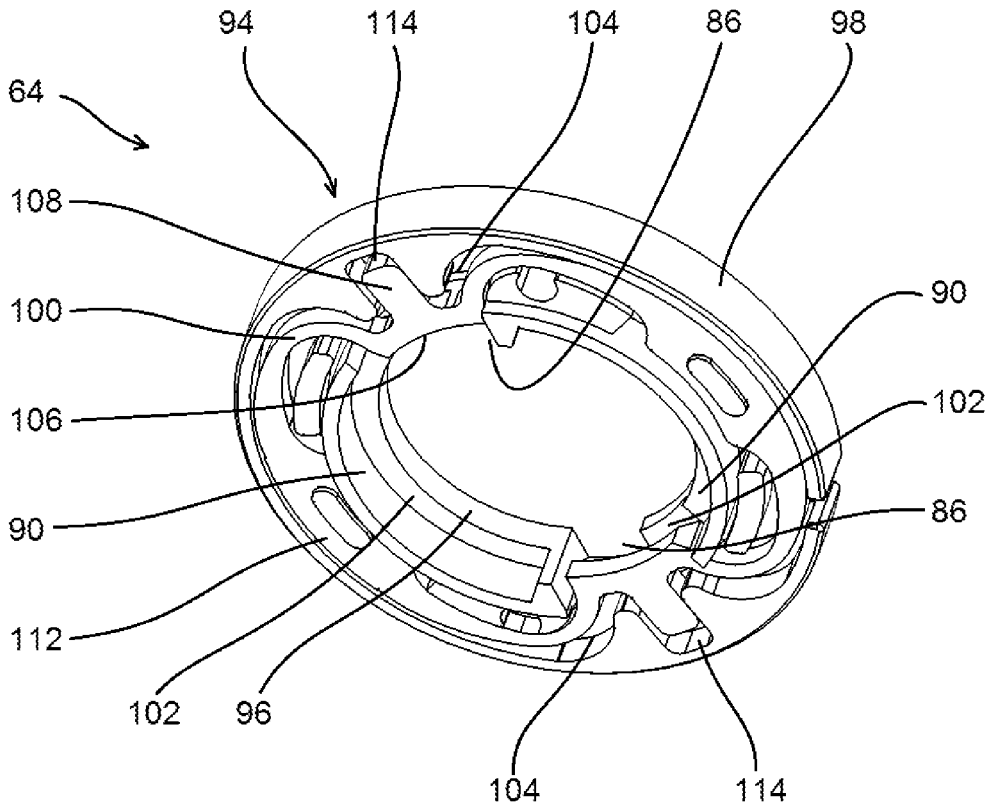
FIG. 16 is a bottom perspective view of a first embodiment of a housing attachment means.
Figure 17:
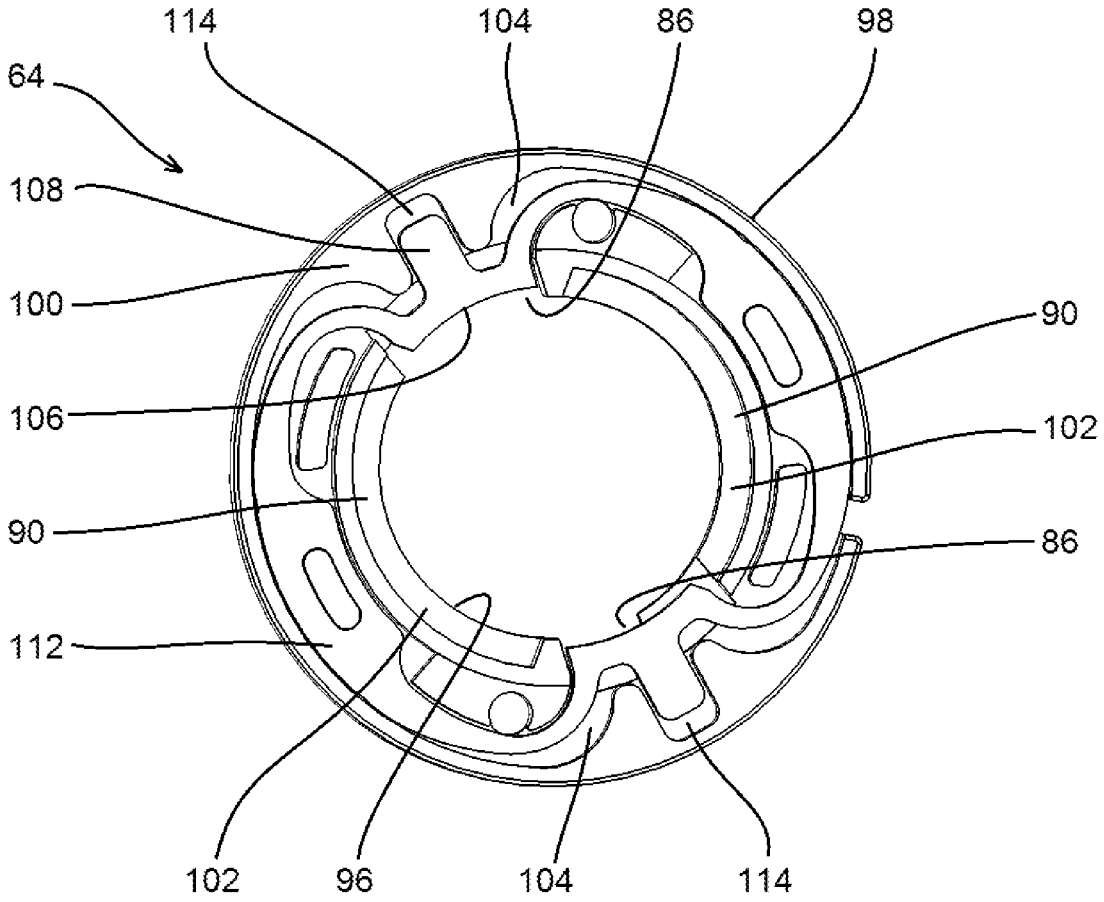
FIG. 17 is a bottom plan view of the first embodiment of a housing attachment means shown in FIG. 16.
Figure 18:
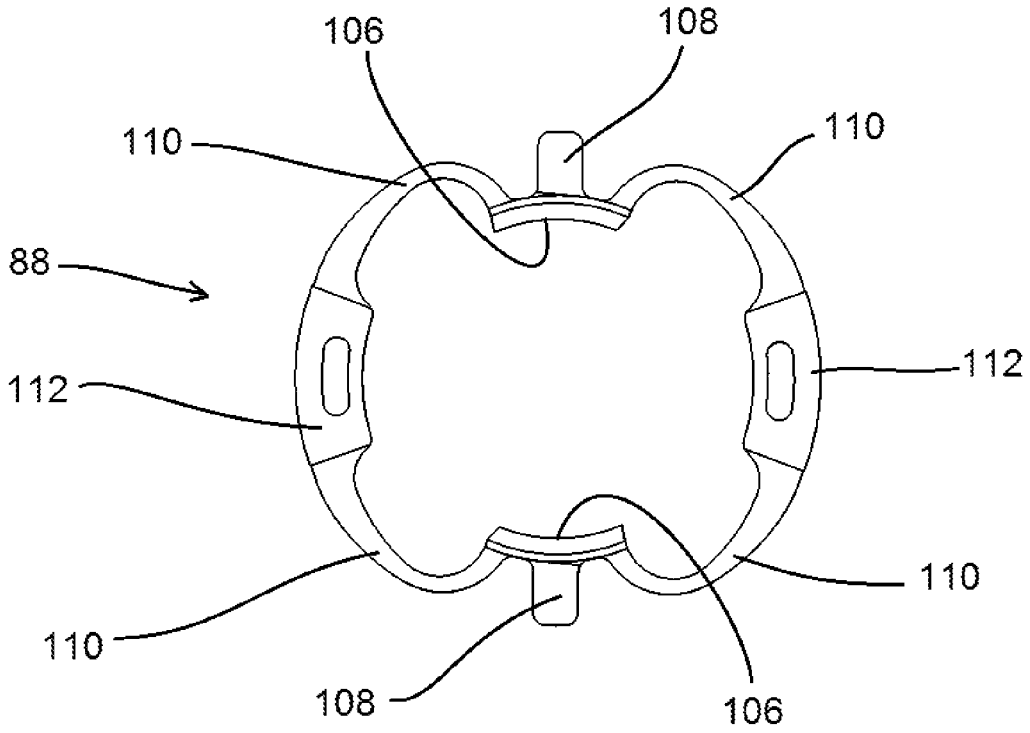
FIG. 18 is a top view of a retainer suitable for use in the first embodiment shown in FIG. 16.
Figure 19:
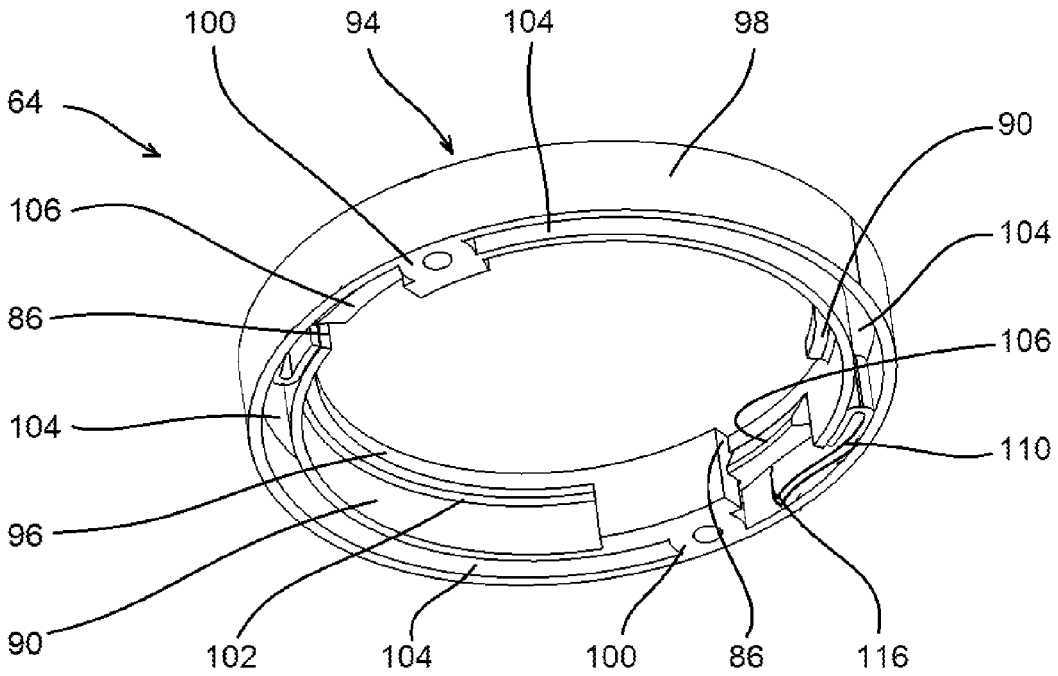
FIG. 19 is a bottom perspective view of a second embodiment of a housing attachment means.
Figure 20:
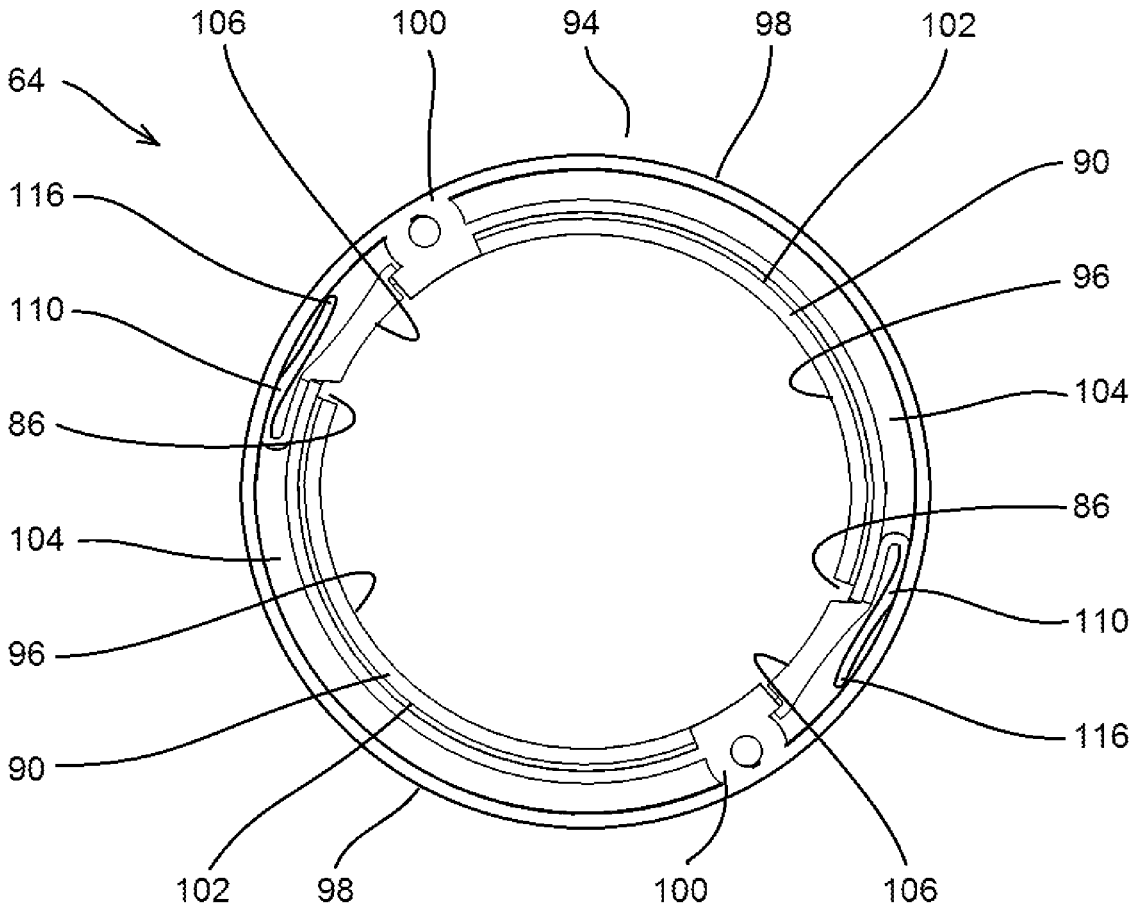
FIG. 20 is a bottom plan view of the second embodiment of a housing attachment means shown in FIG. 19.
Figure 21:
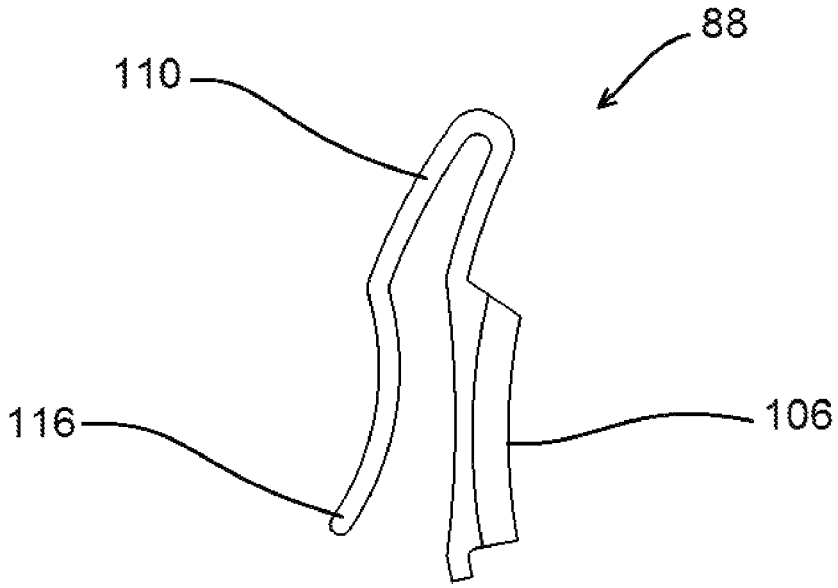
FIG. 21 is a top view of a retainer suitable for use in the second embodiment shown in FIG. 19.
Figure 22:
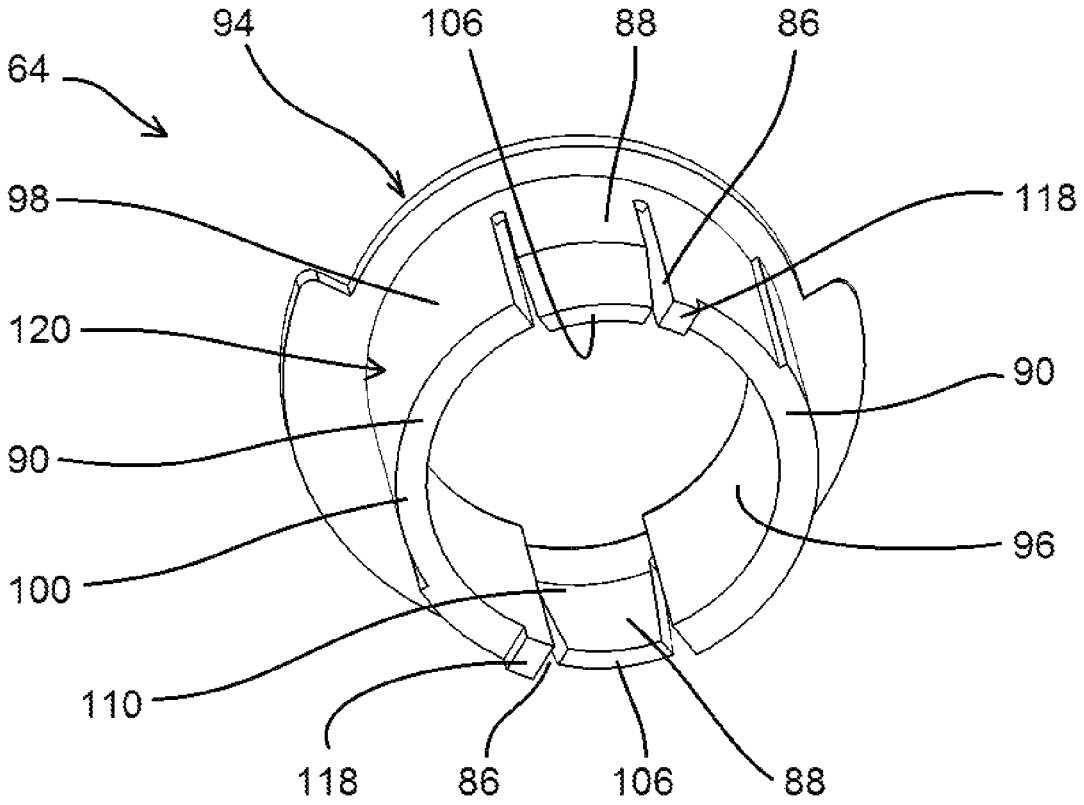
FIG. 22 is a bottom perspective view of a third embodiment of a housing attachment means.
Figure 23:
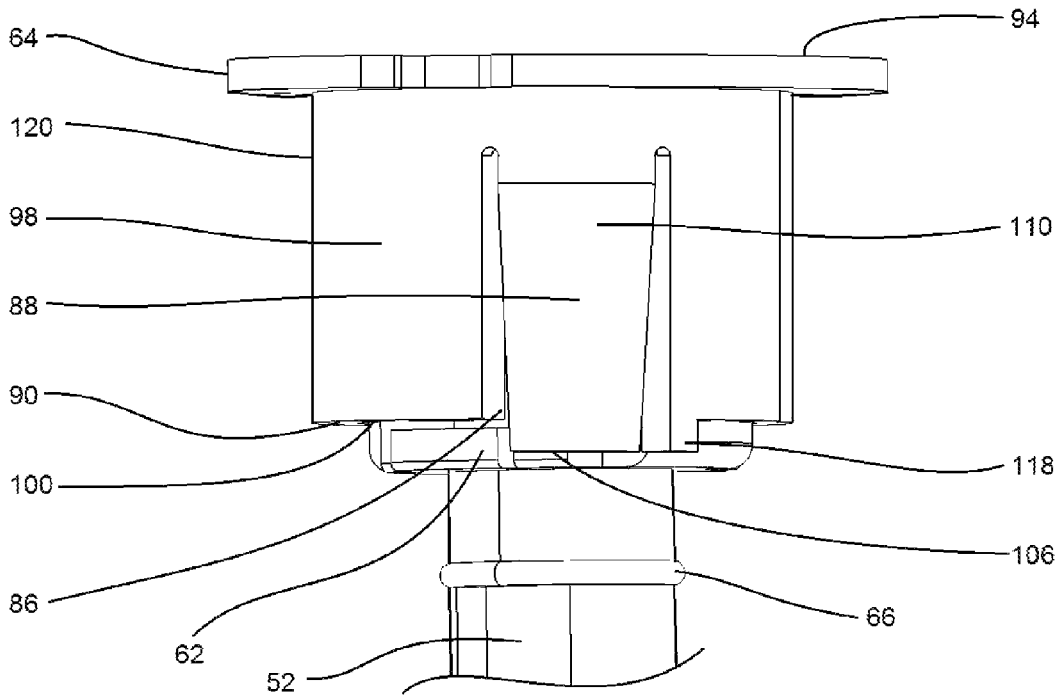
FIG. 23 is a side view of the third embodiment of a housing attachment means shown in FIG. 22 with a sleeve insert.
Figure 24:
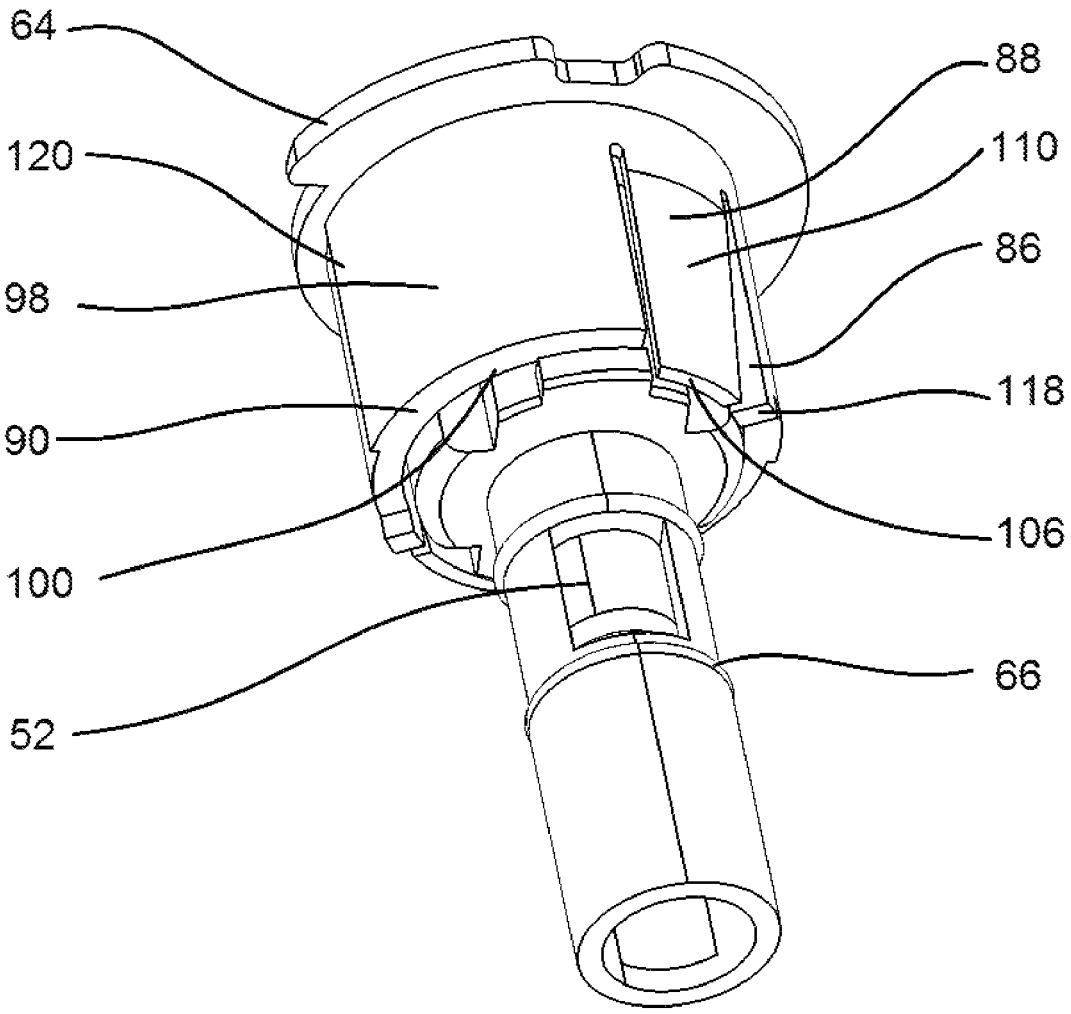
FIG. 24 is a bottom perspective view of the third embodiment of a housing attachment means shown in FIG. 22 with the sleeve insert.

FIGS. 16 through 24 are illustrative examples of housing attachment means suitable for use with the present invention. FIG. 16 is a bottom perspective view and FIG. 17 is a bottom plan view of a first embodiment of a housing attachment means. FIG. 18 is a top view of a retainer that can be used with the housing attachment means shown in FIGS. 16 and 17. FIG. 19 is a bottom perspective view and FIG. 20 is a bottom plan view of a second embodiment of a housing attachment means. FIG. 21 is a top view of a retainer that can be used with the housing attachment means shown in FIGS. 19 and 20. FIG. 21 is a side view and FIG. 21 is a bottom perspective view of a third embodiment of a housing attachment means. FIG. 18 is a top view of a retainer suitable for use in the second embodiment shown in FIG. 16 presenting more detail. FIG. 21 is a top view of a retainer suitable for use in the second embodiment shown in FIG. 19 presenting more detail. FIG. 22 is a bottom perspective view of a third embodiment of a housing attachment means. FIG. 23 is a side view and FIG. 24 is a bottom perspective view of the third embodiment of a housing attachment means shown in FIG. 22 with a sleeve insert.

FIG. 1 illustrates a preferred embodiment of the present invention 10 comprising, among other things, housing 12 with water inlet port 42 and air inlet port 44 integrally formed thereon. Water inlet port 42 admits water into housing 12 and air inlet port 44 admits air into housing 12. This particular embodiment thus illustrates a venturi-type jet, wherein water and air are mixed to provide a therapeutic effect. Those skilled in the art will readily recognize other equivalent non-venturi-type hydrotherapy jets, each of which are within the scope of the present invention.

Housing 12 preferably is a generally hollow structure having various sized cylindrical sections 16, 18, 20, 58 forming a generally continuous housing outer wall having an inner surface and an outer surface, a generally continuous interior, open end 28 for accepting sleeve 14 and the nozzle (not shown), and closed end 22 typically opposite open end 28. Cylindrical sections 16, 18, 20, 58 correspond to generally similarly shaped chambers on sleeve 14, and will be disclosed in more detail herein. Generally proximal to closed end 22, housing 12 has water inlet port 42 and air inlet port 44 allowing for water and air to be introduced to the interior of the housing 12. Housing 12 also preferably has flange 24 and threaded portion 58 proximal to open end 28 for attaching housing 12 to a tub wall. Housing 12 further preferably has a housing attachment means (see FIGS. 4-9) for rotatably attaching sleeve 14 within housing 12, housing attachment means preferably being located within the interior of housing 12 and attached to the inner surface of the housing outer wall.

Housing 12 is mounted through the tub shell in a more or less conventional manner. For example, housing 12 is placed through a hole in the tub shell such that flange 24 contacts the inner (wet side) surface of the tub shell. Housing 12 is secured to a spa shell via flange 24 (see FIGS. 2-9) and screw threads 56 formed on threaded portion 58 adjacent outer flange 24. A cooperatively threaded nut (not shown) cooperates in mating communication with screw threads 56 so that tightening the nut tightens housing 12 against the spa shell, with the spa shell being sandwiched between flange 24 and nut, with flange 24 being located within the spa tub (wet side) and the remainder of housing 12 being located outside of the spa tub (dry side). Nut is placed over housing 12 from the outer side (dry side) and threaded onto threaded portion 58 of housing 12. Nut is rotated about threaded portion 58 until it contacts the outer (dry side) surface of the tub shell, sandwiching the tub shell between flange 24 and the nut, thus securing housing 12 onto the tub shell.

Housing 12 illustrated is exemplary, as a result, a variety of housing constructions are possible, including provision of a plurality of transitional interfaces as described above as well as variation in the sharpness or smoothness of the transitional interfaces. Those skilled in the art will recognize various equivalent housing constructions, each of which is within the scope of the present invention.

FIGS. 2 and 3 illustrate a preferred embodiment of the invention 10, with sleeve 14 separated from housing 12. Sleeve 14 has a structure and configuration generally analogous to housing 12. Sleeve 14 also preferably is a generally hollow structure having various sized cylindrical sections 32, 34, 36, 38. Aeration section 32 comprises aeration chamber 40 and water port 50 and air ports 52, which allow water and air, respectively, to flow from housing 12 into aeration chamber 40, where air and water mix to produce aerated water. Water port 50 corresponds to and cooperates with water inlet port 42 and air ports 52 correspond to and cooperate with air inlet port 44, as discussed in more detail herein. Spacers 66 extend radially outward from the exterior surface of aeration section 32 for centering and stabilizing aeration section 32, and thus sleeve 14, within cylindrical section 16, and thus within housing 12 and to help ensure that air flowing through air inlet port 44 flows through air ports 52 into aeration chamber 40.

Nozzle connection section 34 comprises clip 60 for securing nozzle into sleeve 14. Nozzle has a connector that cooperates with clip 60 to secure nozzle within sleeve. Nozzle can be removed from sleeve 14 for replacement by removing sleeve 14 from housing 12, and manipulating clip 60 so as to release nozzle. Nozzle housing section 36 is generally shaped so as to hold and protect nozzle, such as a nozzle having a typical eyeball configuration. For example, the curved end of nozzle housing section 36 proximal to nozzle connection section 34 can have the same general curvature as an eyeball nozzle. Attachment section 38 comprises sleeve attachment means 62 for cooperating with a first attachment means, namely housing attachment means 64 (see FIGS. 4-9) to rotatably secure sleeve 14 within housing 12.

Sections 32, 34, 36, 38 form a generally continuous sleeve outer wall having an inner surface and an outer surface, a generally continuous interior, first open end 46 for accepting the nozzle, and second open end 48 typically opposite the first open end 46 and/or a water port 50 for accepting a water flow from water inlet port 42 of housing 12, specifically to the aeration chamber 32. Generally proximal to second open end 48, sleeve 14 comprises at least one air port 52 allowing for air to be introduced to the interior of sleeve 14, specifically also to aeration chamber 32. Sleeve 14 also preferably has a face cover 30 proximal to or at first open end 46 for gripping by the user so as to rotate sleeve 14 and for providing an aesthetically pleasing cover for flange 24. Sleeve 14 further preferably comprises a second attachment means, namely sleeve attachment means 62 for cooperating with housing attachment means 64, for rotatably attaching sleeve 14 within housing 12, sleeve attachment means 62 preferably being located on the exterior of sleeve 14 and attached to the outer surface of the sleeve outer wall.

FIGS. 4 and 5 illustrate cross-sectional views of the preferred embodiment of the invention shown in FIGS. 2 and 3. FIGS. 4 and 5 are similar cross-sections, with FIG. 5 being rotated axially about Arrow A approximately 90° relative to FIG. 4. The generally hollow structure of housing 12 can be seen in more detail, with the various sized cylindrical sections 16, 18, 20, 58 forming a generally continuous housing outer wall 70 having an inner surface 74 and an outer surface 76, a generally continuous interior 78, open end 28 for accepting sleeve 14 and the nozzle (not shown), and closed end 22 typically opposite open end 28. The generally hollow structure of sleeve 14 also can be seen in more detail, with the various sized cylindrical sections 32, 34, 36, 38 forming a generally continuous sleeve outer wall 72 having an inner surface 80 and an outer surface 82, a generally continuous interior 84, first open end 46 for accepting nozzle (not shown), and second open end 48 typically opposite first open end 46.

FIGS. 4 and 5 also provide additional detail for the means for attaching sleeve 14 to housing 12. Housing attachment means 64 is a generally toroidal structure located circumferentially about the inner wall of cylindrical section 58 (see FIGS. 14 and 15) proximal to the junction with cylindrical section 20. Housing attachment means 64 is securely attached to housing 14 by conventional means, such as screws, clips, adhesives, and/or the like. Sleeve attachment means 62 (see FIGS. 2 and 3) is a protrusion, preferably a generally rectangular cubic stud, extending outwardly from outer surface 82 of cylindrical section 36 proximal to cylindrical section, and which cooperates with housing attachment means 64. More specifically, sleeve attachment means 64 is inserted into entrance slot 86, forced by elastically biased retainer 88, and twisted into retaining path 90. The structure and operation of the means for attaching sleeve 14 to housing 12 will be disclosed in more detail in connection with the discussion of FIGS. 14 and 15 herein.

FIG. 6 is a side sectional view of the embodiment of the invention 10 shown in FIG. 1 in a setting allowing water and air to flow through the invention 10. FIG. 7 is a side sectional view of the embodiment of the invention 10 shown in FIG. 1 rotated axially 90° relative to FIG. 6 also in a setting allowing water and air to flow through the invention 10. FIGS. 6 and 7 illustrate sleeve 14 mounted within housing 12 in the full on position, namely allowing water to flow into housing 12 through water inlet port 42 and then into sleeve through water port 50 (Arrow W), and allowing air to flow into housing 12 through air inlet port 44 and then into sleeve 14 through air ports 52 (Arrow X). Air and water mix in aeration chamber 40 to form aerated water, which then travels through interior 84 of sleeve 14, and particularly through a nozzle mounted within interior 84. Aerated water then is jetted into the spa.

FIGS. 6 and 7 also show an additional section through the wall of sleeve 14 to further illustrate the location of the housing attachment means 64 and the sleeve connection means 62. As can be seen, housing attachment means 64 is attached to housing 12 and sleeve attachment means 62 is attached to sleeve 14 at locations where, when sleeve 14 is inserted into housing 12, sleeve attachment means 62 can interact with housing attachment means 64 so as to rotatably secure sleeve 14 into housing 12.

FIG. 8 is a side sectional view of the embodiment of the invention 10 shown in FIG. 1 in a setting preventing water from flowing through the invention 10, but allowing air to flow through the invention 10. FIG. 9 is a side sectional view of the embodiment of the invention 10 shown in FIG. 1 rotated axially 90° relative to FIG. 8 also in a setting preventing water from flowing through the invention 10, but allowing air to flow through the invention 10. Thus, FIGS. 8 and 9 illustrate sleeve 14 mounted within housing 12 in the off position, namely preventing water from flowing into housing 12 (Arrow W), but allowing air to flow through the invention 10 (Arrow X).

FIGS. 8 and 9 also show an additional section through the wall of sleeve 14 to further illustrate the location of the housing attachment means 64 and the sleeve connection means 62.

FIGS. 6-9 also show how face cover 30 preferably is structured or configured to extend over flange 24 for both aesthetic purposes, namely hiding flange 24 from view, and for practical purposes, namely preventing accidental attempted rotation of flange 24, which could loosen housing 12 from spa tub wall. Further, face cover 30 preferably does not contact flange 24 so that face cover 30 can be rotated without interference from flange 24.

The water flow to aeration chamber 40 may be shut off by rotating face cover 30, which thereby rotates sleeve 14. More particularly, the flow of water is cut off into sleeve 14, and therefore into and through aeration chamber 40, as the water port 50 is no longer aligned with the water inlet port 42. Outer wall 72 at aeration section 32 effectively covers and closes inlet water port 42. The flow of water also can be proportionally reduced by rotating sleeve 14 to various positions where only a portion of outer wall 72 is overlapping water inlet port 42, thus reducing the cross-sectional area of water flow into sleeve 14.

Similarly, the air flow to aeration chamber 40 preferably may be shut off by rotating face cover 30, which thereby rotates sleeve 14 such that the air port 52 rotates away from and therefore closes air inlet port 44. The flow volume of air preferably also can be proportionally reduced by only partially rotating face cover 30 to a position where only a portion of air inlet port 44 is open, thus reducing the cross-section of the open area of air inlet port 44 cooperating with air port 52 (see FIGS. 10-13 for alternative embodiments).

FIG. 10 is a side view of an alternative structure of aeration section 32 that allows air to flow through the invention 10 when water is allowed to flow through the invention 10 and prevents air from flowing through the invention 10 when water is prevented from flowing through the invention 10. More specifically, when sleeve 14 is in the full on position relative to water flow through sleeve 14, air also can flow through sleeve 14, and when sleeve 14 is in the full off position relative to water flow through sleeve 14, air cannot flow through sleeve 14. More specifically, while the embodiment shown in FIGS. 2-9 comprises four air ports 52 generally evenly spaced about the circumference of aeration section 32, the embodiment shown in FIG. 10 comprises one air port 52 generally in line with water port 50. Thus, when sleeve 14 is rotated to a position where water port 50 is in line with water inlet port 42 such that water flows through water port 50, air port 52 is in line with and cooperates with air inlet port 44 and allows air to flow through the invention 10. Similarly, when sleeve 14 is rotated to a position where outer wall 72 blocks water inlet port 42, such that water is prevented from flowing through water port 50, air port 52 does not cooperate with air inlet port 44 and can prevent air from flowing through the invention 10. FIG. 12 is a side view of the alternate embodiment of the invention 10 shown in FIG. 10 rotated axially 90° relative to FIG. 10.

FIG. 11 is a side view of an alternate structure of aeration section 32 that prevents air from flowing through the invention 10 when water is allowed to flow through the invention 10 and allows air to flow through the invention 10 when water is prevented from flowing through the invention 10. More specifically, when sleeve 14 is in the full on position relative to water flow through sleeve 14, air cannot flow through sleeve 14, and when sleeve 14 is in the full off position relative to water flow through sleeve 14, air can flow through sleeve 14. More specifically, while the embodiment shown in FIGS. 2-9 comprises four air ports 52 generally evenly spaced about the circumference of aeration section 32, the embodiment shown in FIG. 11 comprises one or two air ports 52 generally out of line with water port 50. Thus, when sleeve 14 is rotated to a position where water port 50 is in line with water inlet port 42 such that water flows through water port 50, air port 52 does not cooperate with air inlet port 44 and can prevent air from flowing through the invention 10. Similarly, when sleeve 14 is rotated to a position where outer wall 72 blocks water inlet port 42, such that water is prevented from flowing through water port 50, air port 52 is in line with and cooperates with air inlet port 44 and allows air to flow through the invention 10. FIG. 13 is a side view of the alternate embodiment of the invention 10 shown in FIG. 11 rotated axially 90° relative to FIG. 11.

FIGS. 14 and 15 are end views, with sleeve 14 partly in section, along line 14-14' of FIG. 6 and along line 15-15' of FIG. 7, respectively, for better generally illustrating the means for attaching sleeve 14 to housing 12. More specifically, FIGS. 14 and 15 are end views of the invention from open end 28 of housing 12 and first open end 46 of sleeve 14. Housing attachment means 64 is a generally toroidal shaped component secured within housing 12, preferably about the circumference of cylindrical section 58 proximal to the junction with cylindrical section 20. Shoulder 92 (see FIGS. 4-9) provides a support or platform on which housing attachment means 64 rests.

FIGS. 16 through 21 are illustrative examples of housing attachment means 64 suitable for use with the present invention. FIG. 16 is a bottom perspective view and FIG. 17 is a bottom plan view of a first embodiment of a housing attachment means 64. FIG. 18 is a bottom perspective view and FIG.

19 is a bottom plan view of a second embodiment of a housing attachment means 64. FIG. 20 is a side view and FIG. 21 is a bottom perspective view of a third embodiment of a housing attachment means 64.

Generally, housing attachment means 64 comprises a first side or surface 94 facing open end 28, a second side or surface 100 facing shoulder 92, the second surface 100 (see FIGS. 4 and 5) being opposite the first surface 94, an inner side or surface 96, preferably an inner circumferential surface, facing housing interior 78, and an outer side or surface 98, preferably an outer circumferential surface, facing housing inner surface 74. Entrance slot 86 is a notch formed into inner circumferential surface 96 and extending from first surface 94 towards or to second surface 100. Entrance slot 86 has a width (in the direction between inner circumferential surface 96 and outer circumferential surface 98) sufficient to allow sleeve attachment means 62 to fit therein. Entrance slot 86 has a depth (in the direction between first surface 94 and second surface 100) at least far enough to allow sleeve attachment means 62 to be manipulated from entrance slot 86 to retaining path 90. Entrance slot 86 can extend the entire distance between first surface 94 and second surface 100. Retaining path 90 is an elongated notch formed into and extending along inner circumferential surface 96 from entrance slot 86 preferably at least 90° (¼ the circumference) along inner circumferential surface 96. Retaining wall 102 separates retaining path 90 from first surface 94 so as to retain sleeve attachment means 62 within retaining path 90. Preferably, there are two entrance slots 86/retaining path 90 combinations diametrically opposed from each other on housing attachment means 64.

Elastically or spring biased retainer 88 can be located at the juncture between entrance slot 86 and retaining path 90. The purpose of retainer 88 is to removably retain sleeve attachment means 62 within retaining path 90, so as to removably retain sleeve 14 within housing 12. Retainer 88 can be a flexible or elastic material, or a spring steel, attached to or in a recess formed in housing attachment means 64, or can be a component spring-biased on or in a recess formed in housing attachment means 64. In the locked or retaining position, retainer 88 extends radially inward from housing attachment means 64 so as to create a blocking dam at the juncture between retaining path 90 and entrance slot 86. In the unlocked or releasing position, retainer 88 is pressed outward towards or into a recess formed in housing attachment means 64. When in the locked or retaining position, and with sleeve attachment means 62 within retaining path 90, retainer 88 prevents sleeve attachment means 62 from exiting retaining path 90 without retainer 88 being pressed outwards into the unlocked or releasing position.

Sleeve attachment means 62 is a generally rectangular cubic stud extending radially outwardly from outer surface 82 of cylindrical section 36 proximal to cylindrical section, and which cooperates with housing attachment means 64.

FIGS. 16 through 23 are more specific illustrative examples of housing attachment means 64 suitable for use with the present invention. FIG. 16 is a bottom perspective view and FIG. 17 is a bottom plan view of a first embodiment of a housing attachment means. In this first illustrative embodiment, housing attachment means 64 comprises first surface 94 facing open end 28, second surface 100 facing shoulder 92, second surface 100 (see FIGS. 4 and 5) being opposite first surface 94, inner circumferential surface 96 facing housing interior 78, and outer circumferential surface 98 facing housing inner surface 74. Entrance slot 86 is a notch formed into inner circumferential surface 96 and extending from first surface 94 towards or to second surface 100. Entrance slot 86 has a width (in the direction between inner circumferential surface 96 and outer circumferential surface 98) sufficient to allow sleeve attachment means 62 to fit therein. Entrance slot 86 has a depth (in the direction between first surface 94 and second surface 100) extending the entire distance between first surface 94 and second surface 100. Retaining path 90 is an elongated notch formed into and extending along inner circumferential surface 96 from entrance slot 86 preferably at least 90° (¼ the circumference) along inner circumferential surface 96. Retaining wall 102 separates retaining path 90 from first surface 94 so as to retain sleeve attachment means 62 within retaining path 90. Preferably, there are two entrance slots 86/retaining path 90 combinations diametrically opposed from each other on housing attachment means 64. Housing attachment means 64 further comprises retainer channel 104 accessible from second surface 100. Retainer channel 104 is configured to accept and retain retainer 88.

Retainer 88 is contained within retainer channel 104. In this embodiment, as shown in more detail in FIG. 18, retainer 88 is a generally circular component comprising dam 106, flexure arm 110, and support 112. Retainer 88 is manufactured from an at least partially flexible or elastic material. Flexure arm 110 is a relatively thinner portion of support 112, and is of a thickness reduced sufficiently so as to be flexible. Dam 106 is attached to support 112 via flexure arms 110 so as to allow dam 106 to flex within entrance slot 86. Optional guide 108 is attached to a side of dam 106 opposite entrance slot 86 and is slidably retained within optional guide slot 114 so as to help ensure that dam 106 slides along a radial line relative to housing attachment means 64. Support 112 is secured within retainer channel 104 so as to hold retainer 88 generally in the same position within housing attachment means 64.

Dam 106 can be located at the juncture between entrance slot 86 and retaining path 90. The purpose of retainer 88 in general and dam 106 in particular is to removably retain sleeve attachment means 62 within retaining path 90, so as to removably retain sleeve 14 within housing 12. In the locked or retaining position, dam 106 extends radially inward from housing attachment means 64 so as to create a blocking dam at the juncture between retaining path 90 and entrance slot 86. In the unlocked or releasing position, dam 106 is pressed outward towards or into retainer channel 104 formed in housing attachment means 64. When in the locked or retaining position, and with sleeve attachment means 62 within retaining path 90, dam 106 prevents sleeve attachment means 62 from exiting retaining path 90 without dam 106 being pressed outwards into the unlocked or releasing position.

FIG. 19 is a bottom perspective view and FIG. 20 is a bottom plan view of a second embodiment of a housing attachment means. In this second illustrative embodiment, housing attachment means 64 comprises first surface 94 facing open end 28, second surface 100 facing shoulder 92, second surface 100 (see FIGS. 4 and 5) being opposite first surface 94, inner circumferential surface 96 facing housing interior 78, and outer circumferential surface 98 facing housing inner surface 74. Entrance slot 86 is a notch formed into inner circumferential surface 96 and extending from first surface 94 towards or to second surface 100. Entrance slot 86 has a width (in the direction between inner circumferential surface 96 and outer circumferential surface 98) sufficient to allow sleeve attachment means 62 to fit therein. Entrance slot 86 has a depth (in the direction between first surface 94 and second surface 100) extending the entire distance between first surface 94 and second surface 100. Retaining path 90 is an elongated notch formed into and extending along inner circumferential surface 96 from entrance slot 86 preferably at least 90° (¼ the circumference) along inner circumferential surface 96. Retaining wall 102 separates retaining path 90 from first surface 94 so as to retain sleeve attachment means 62 within retaining path 90. Preferably, there are two entrance slots 86/retaining path 90 combinations diametrically opposed from each other on housing attachment means 64. Housing attachment means 64 further comprises retainer channel 104 accessible from second surface 100. Retainer channel 104 is configured to accept and retain retainer 88.

Retainer 88 is contained within retainer channel 104. In this embodiment, as shown in more detail in FIG. 21, retainer 88 is a spring clip component comprising dam 106 and flexure arm 110. Retainer 88 is manufactured from an at least partially flexible or elastic material, and is generally U-shaped with dam 106 on one end of the U and flexure arm 110 comprising the remainder of retainer 88. Retainer is placed within retainer channel 104 such that dam 106 can be located at the juncture between entrance slot 86 and retaining path 90. The purpose of retainer 88 in general and dam 106 in particular is to removably retain sleeve attachment means 62 within retaining path 90, so as to removably retain sleeve 14 within housing 12. In the locked or retaining position, dam 106 extends radially inward from housing attachment means 64 so as to create a blocking dam at the juncture between retaining path 90 and entrance slot 86. In the unlocked or releasing position, dam 106 is pressed outward generally towards or into retainer channel 104 and more specifically towards the other end of the U-shaped retainer 88 structure, namely, the end 116 of flexure arm 110 opposite dam 106. When in the locked or retaining position, and with sleeve attachment means 62 within retaining path 90, dam 106 prevents sleeve attachment means 62 from exiting retaining path 90 without dam 106 being pressed outwards into the unlocked or releasing position FIG. 22 is a bottom perspective view of a third embodiment of a housing attachment means 46. FIG. 23 is a side view and FIG. 24 is a bottom perspective view of the third embodiment of a housing attachment means 46 shown in FIG. 22 with the sleeve 14 insert. In this third illustrative embodiment, housing attachment means 64 comprises an elongated cylindrical structure 120 when compared to the first and second embodiments, and is a unitary structure in that retainer 88 is not a separate component. This third embodiment also comprises first surface 94 facing open end 28, second surface 100 facing shoulder 92, second surface 100 (see FIGS. 4 and 5) being opposite first surface 94, inner circumferential surface 96 facing housing interior 78, and outer circumferential surface 98 facing housing inner surface 74. Entrance slot 86 is a notch formed into inner circumferential surface 96 and extending from first surface 94 towards or to second surface 100. Entrance slot 86 has a width (in the direction between inner circumferential surface 96 and outer circumferential surface 98) sufficient to allow sleeve attachment means 62 to fit therein. Entrance slot 86 has a depth (in the direction between first surface 94 and second surface 100) extending the entire distance between first surface 94 and second surface 100. Retaining path 90 extends circumferentially about the second surface 100 from entrance slot 86 preferably at least 90° (¼ the circumference) along second surface 100 to stop 118. Preferably, there are two entrance slots 86/retaining path 90 combinations diametrically opposed from each other on housing attachment means 64.

Retainer 88 is formed from elongated cylindrical structure 120. In this embodiment, retainer 88 is a spring clip component comprising dam 106 and flexure arm 110. Retainer 88 extends from proximal to first surface 94 downwards towards second surface 100 and also slightly inwards towards housing interior 78. Somewhat more specifically, retainer 88 is partly within the circumferential cylinder, generally corresponding to the volume between inner circumferential surface 96 and outer circumferential surface 98 that makes up elongated cylindrical structure 120, and partly within housing interior 78 inwards of elongated cylindrical structure 120. Retainer 88, and thus housing attachment means, is manufactured from an at least partially flexible or elastic material. The end of retainer 88 proximal to second surface 100 constitutes dam 106. In this embodiment, sleeve 14 is inserted into housing attachment means 64 such that sleeve attachment means 62 slide down along press against retainer 88, thus forcing retainer 88 outwards. After sleeve attachment means 62 passes by dam 106, retainer 88 snaps inwards against sleeve 14 outer surface thus retaining sleeve 14 within housing attachment means 64 in the locked or retaining position. Sleeve 14 then can be rotated such that sleeve attachment means 62 is rotated into retaining path 90. Sleeve 14 thus can be rotated between dam 106 and stop 118.

In the locked or retaining position, dam 106 extends radially inward from the remainder of elongated cylindrical structure 120 of housing attachment means 64 so as to create a blocking dam at the juncture between retaining path 90 and entrance slot 86. In the unlocked or releasing position, dam 106 is pressed outward generally towards housing 12. When in the locked or retaining position, and with sleeve attachment means 62 within retaining path 90, dam 106 prevents sleeve attachment means 62 from exiting retaining path 90 without dam 106 being pressed outwards into the unlocked or releasing position.

Housing attachment means 64 is attached to housing 12 and sleeve attachment means 62 is attached to sleeve 12 in cooperating positions such that when sleeve 14 is attached to housing 12 with sleeve attachment means 62 within retaining path 90, sleeve 14 can be rotated at least from a first position where water inlet port 42 and water port 50 align so as to allow water to flow through water inlet port 42 into and through water port 50 to aeration chamber 40 (the on position) to a second position where water inlet port 42 and water port 50 do not align so as to prevent water from flowing through water inlet port 42 into and through water port 50 to aeration chamber 40 (the off position), and back to the first position.

As disclosed, sleeve 14 and housing 14 form a two-part device that allows a user to turn on and off the water flow through a water jet simply and easily by rotating face cover 30 of sleeve 14. In operation, housing 12 is secured to a spa tub wall through a previously drilled, cut or formed hole. Sleeve 14, second open end 48 first, is inserted into housing 12 through housing open end 28, aligning sleeve attachment means 62 with entrance slot 86. Sleeve attachment means 62 is forced over retainer 88, forcing retainer 88 from the locked position to the unlocked position, so as to align with retaining path 90. Sleeve 14 then is rotated using face cover 30 so that sleeve attachment means 62 rotates into retaining path 90. Retainer 88 returns to the locked position so as to maintain sleeve attachment means 62 within retaining path 90 and to rotatably retain sleeve 14 within housing 12. Sleeve attachment means 64 is inserted into entrance slot 86, forcing retainer 88 outwards into the unlocked or releasing position, and twisted into retaining path 90, thus allowing retainer 88 to snap back inwards into the locked or retaining position. A nozzle can be inserted into sleeve 14 either before or after sleeve 14 is mounted within housing 12. Nozzle is retained within sleeve 14 via clips 60.

Sleeve 14 now can be rotated within housing 12 via face cover 30. In a first position, water inlet port 42 and water port 50 align so as to allow water to flow through water inlet port 42 into and through water port 50 to aeration chamber 40 (the on position). In a second position, water inlet port 42 and water port 50 do not align so as to prevent water from flowing through water inlet port 42 into and through water port 50 to aeration chamber 40 (the off position). Sleeve 14 also can be rotated and left in intermediate positions between the first position and the second position so as to control the flow rate of water and/or air into the aeration chamber, and thus providing aerated water to the spa in flow rates varying in a range from full on to full off.

As in conventional water jets, aeration chamber 40 creates an aerated water stream by the mixing of air and water, which have been introduced into aeration chamber 40 via air inlet port 42 and water inlet port 44 in housing 12 and air port 52 and water port 50 in sleeve 14, and aligned with aeration chamber 40. The aerated water stream then flows through sleeve 14 and then through the nozzle into the artificial water structure (for ease of this disclosure, all artificial water structures such as but not limited to spas, hot tubs, JACUZZI®, pools, fountains, ponds, and whirlpools will be referred to herein as a "spa" or "spas"). Preferably, the nozzle does not extend into the spa beyond face cover 30 and is accessible from the spa, namely from the front side of the jet 10, if the user desires to change the nozzle. The nozzle has a fluid passage, which is in fluid communication with both aeration chamber 40 and the spa, to introduce aerated water into the spa.

The foregoing detailed description of the preferred embodiments and the appended figures have been presented only for illustrative and descriptive purposes and are not intended to be exhaustive or to limit the scope and spirit of the invention. The embodiments were selected and described to best explain the principles of the invention and its practical applications. One of ordinary skill in the art will recognize that many variations can be made to the invention disclosed in this specification without departing from the scope and spirit of the invention.

What is claimed is:

1. A water jet comprising:

a) a housing comprising a water inlet port, an air inlet port, and a first attachment means, the housing having a generally hollow interior, wherein the first attachment means comprises:

i) a first side, a second side opposite the first side, an inner side, and an outer side;

ii) an entrance slot accessible from the inner side and extending along the inner side a distance between the first side and the second side;

iii) a retaining path extending along at least one-quarter of the circumference of the first attachment means from the entrance slot, the retaining path for retaining a second attachment means; and iv) a retainer located at a juncture between the entrance slot and the retaining path, the retainer configured to move from a first position to a second position such that the retainer regulates the movement of the second attachment means between the entrance slot and the retaining path; and b) a sleeve rotatably mounted within the housing, the sleeve comprising a water port, an air port, the second attachment means, and an aeration chamber, the sleeve having a generally hollow interior and the aeration chamber being located within the generally hollow interior of the sleeve, wherein the second attachment means is a protrusion extending radially outwardly from an outer surface of the sleeve, wherein when the retainer is in the first position, the second attachment means is prevented from exiting the retaining path without the retainer being moved into the second position, wherein when the retainer is in the second position, the second attachment means is allowed to enter and exit the retaining path, the retainer additionally configured to move from the first position to the second position when the second attachment means travels along the entrance slot towards the retaining path and presses against the retainer, and wherein the housing and the sleeve are rotatably and releasably connected to each other whereby the sleeve rotates within the housing along the retaining path.

2. The water jet as claimed in claim 1, wherein the first attachment means further comprises a retaining wall defining, at least in part, the retaining path along the first side, the entrance slot configured to receive and to direct the second attachment means past the retaining wall, the retaining path accessible via the entrance slot, and the retaining wall configured to, at least in part, retain the second attachment means along the retaining path.

3. The water jet as claimed in claim 1, wherein the entrance slot has a width in a direction between the inner side and the outer side of the first attachment means sufficient to allow the second attachment means to fit therein.

4. The water jet as claimed in claim 3, wherein the entrance slot has a depth in a direction between the first side and the second side of the first attachment means at least far enough to allow the second attachment means to be manipulated from the entrance slot to the retaining path.

5. The water jet as claimed in claim 4, comprising two of the entrance slots and two of the retaining paths.

6. The water jet as claimed in claim 5, wherein the two entrance slots are diametrically opposed from each other on the inner side of the first attachment means and the two retaining paths are diametrically opposed from each other on the first attachment means.

7. The water jet as claimed in claim 2, wherein the sleeve further comprises means for retaining a water jet nozzle within the generally hollow interior of the sleeve.

8. The water jet as claimed in claim 1, wherein, in the first position, the retainer extends radially inward from the first attachment means so as to create a blocking dam at the juncture between the retaining path and the entrance slot, and, in the second position, the retainer is pressed outward by the second attachment means towards or into a recess formed in the first attachment means so as to allow the second attachment means to pass over the blocking dam and into the retaining path.

9. The water jet as claimed in claim 8, wherein the retainer comprises an at least partially flexible or elastic material, a dam defining the blocking dam, and a flexure arm, the dam being attached to the flexure arm, wherein the retainer is further configured to move from the first position to the second position, and back, about the flexure arm.

10. The water jet as claimed in claim 9, wherein the flexure arm allows the dam to move from the first position to the second position when pressed outward by the second attachment means, and back to the first position after the second attachment means has passed by the dam and into the retaining path.

11. A water jet comprising:

a) a housing comprising a water inlet port, an air inlet port, and a first attachment means, the housing having a generally hollow interior, wherein the first attachment means comprises:

i) a first side, a second side opposite the first side, an inner side, and an outer side;

ii) a retaining wall;

ii) an entrance slot, configured to receive and to direct the second attachment means past the retaining wall;

iii) a retaining path extending along at least one-quarter of the circumference of the first attachment means from the entrance slot, the retaining path accessible via the entrance slot, and the retaining wall configured to, at least in part, retain the second attachment means along the retaining path; and iv) a retainer located at a juncture between the entrance slot and the retaining path, the retainer configured to move from a first position to a second position such that the retainer regulates the movement of the second attachment means between the entrance slot and the retaining path; and b) a sleeve rotatably mounted within the housing, the sleeve comprising a water port, an air port, the second attachment means, and an aeration chamber, the sleeve having a generally hollow interior and the aeration chamber being located within the generally hollow interior of the sleeve, wherein the second attachment means is a protrusion extending radially outwardly from an outer surface of the sleeve; and wherein the first position prevents the second attachment means from exiting the retaining path without the retainer being moved into the second position;

wherein the second position allows the second attachment means to enter and exit the retaining path, the retainer additionally configured to move from the first position to the second position when the second attachment means travels along the entrance slot towards the retaining path and presses against the retainer; and wherein, in the first position, the retainer extends radially inward from the first attachment means so as to create a blocking dam at the juncture between the retaining path and the entrance slot, and, in the second position, the retainer is pressed outward by the second attachment means towards or into a recess formed in the first attachment means so as to allow the second attachment means to pass over the blocking dam and into the retaining path; and wherein the housing and the sleeve are rotatably and releasably connected to each other whereby the sleeve rotates within the housing along the retaining path.

12. The water jet as claimed in claim 11, wherein the entrance slot is accessible from the inner side and extending along the inner side a distance between the first side and the second side, has a width in a direction between the inner side and the outer side of the first attachment means sufficient to allow the second attachment means to fit therein, and a depth in a direction between the first side and the second side of the first attachment means at least far enough to allow the second attachment means to be manipulated from the entrance slot to the retaining path.

13. The water jet as claimed in claim 12, wherein the retainer comprises an at least partially flexible or elastic material, a dam defining the blocking dam, and a flexure arm, the dam being attached to the flexure arm, wherein the retainer is further configured to move from the first position to the second position, and back, about the flexure arm.

14. The water jet as claimed in claim 13, wherein the flexure arm allows the dam to move from the first position to the second position when pressed outward by the second attachment means, and back to the first position after the second attachment means has passed by the dam and into the retaining path.

15. An attachment system for the assembly of a water jet comprising:

a first attachment means situated superficially along a first water jet component piece and a second attachment means situated superficially along a second water jet component piece, the first attachment means and the second attachment means configured to detachably and rotatably mate the first water jet component piece and the second water jet component piece, the first attachment means comprising:

a retaining wall;

an entrance slot configured to receive and to direct the second attachment means past the retaining wall;

a retaining path defined, at least in part, by the retaining wall and accessible via the entrance slot, the retaining path configured to receive and to channel the second attachment means, the retaining wall configured to, at least in part, retain the second attachment means along the retaining path; and a retainer located at a juncture between the entrance slot and the retaining path, the retainer configured to move from a first position to a second position such that the retainer regulates the movement of the second attachment means between the entrance slot and the retaining path; and wherein the first position prevents the second attachment means from exiting the retaining path without the retainer being moved into the second position;

wherein the second position allows the second attachment means to enter and exit the retaining path, the retainer additionally configured to move from the first position to the second position when the second attachment means travels along the entrance slot towards the retaining path and presses against the retainer.

16. The attachment system for the assembly of a water jet as claimed in claim 15, the first attachment means further comprising at least two entrance slots and at least two retaining paths, wherein each of the at least two entrance slots has a disparate configuration relative to the other entrance slot based on at least one of group of parameters consisting of a width, a depth, a height and a shape.

17. The attachment system for the assembly of a water jet as claimed in claim 16, wherein the at least two entrance slots are diametrically opposed from each other superficially along the first attachment means and the at least two retaining paths are diametrically opposed from each other superficially along the first attachment means.

18. The attachment system for the assembly of a water jet as claimed in claim 15, wherein, in the first position, the retainer comprises a first portion configured as a blocking dam at the juncture between the retaining path and the entrance slot, and, in the second position, the first portion of the retainer is displaced by the second attachment means so as to allow the second attachment means to pass over the blocking dam and into the retaining path.

19. The attachment system for the assembly of a water jet as claimed in claim 18, wherein the retainer further comprises an at least partially flexible or elastic material and a second portion configured, at least in part, as flexure arm, the first portion communicatively coupled to the second portion, wherein the retainer is further configured to move from the first position to the second position, and back, about the flexure arm.

20. The attachment system for the assembly of a water jet as claimed in claim 19, wherein the second portion allows the first portion to move from the first position to the second position when pressed outward by the second attachment means, and back to the first position after the second attachment means has passed by the dam and into the retaining path.

21. The attachment system for the assembly of a water jet as claimed in claim 15, wherein at least one of a group consisting of the first water jet component piece and the second water jet component piece further comprises a third attachment means configured to detachably couple a water jet nozzle.

* * * * *